US011377320B2

(12) United States Patent
Fuchi et al.

(10) Patent No.: US 11,377,320 B2
(45) Date of Patent: Jul. 5, 2022

(54) RELAY CONVEYANCE DEVICE, IMAGE FORMING SYSTEM, COMBINATION OF IMAGE FORMING SYSTEM, AND SHEET CONVEYANCE DEVICE

(71) Applicant: KYOCERA Document Solutions Inc., Osaka (JP)

(72) Inventors: Masami Fuchi, Osaka (JP); Sachio Izumichi, Osaka (JP); Masayuki Kakuta, Osaka (JP); Risa Hibino, Osaka (JP); Seiji Okada, Osaka (JP)

(73) Assignee: KYOCERA Document Solutions Inc.

( * ) Notice: Subject to any disclaimer, the term of this patent is extended or adjusted under 35 U.S.C. 154(b) by 189 days.

(21) Appl. No.: 16/863,983

(22) Filed: Apr. 30, 2020

(65) Prior Publication Data

US 2020/0354182 A1 Nov. 12, 2020

(30) Foreign Application Priority Data

May 7, 2019 (JP) ..... JP2019-087426

(51) Int. Cl.
*B65H 29/50* (2006.01)
*B65H 29/14* (2006.01)

(52) U.S. Cl.
CPC ..... *B65H 29/50* (2013.01); *B65H 29/14* (2013.01); *B65H 2301/512565* (2013.01)

(58) Field of Classification Search
CPC ..... B65H 29/50; B65H 29/14; B65H 2301/512565
See application file for complete search history.

(56) References Cited

U.S. PATENT DOCUMENTS 9,042,806 B2 * 5/2015 Tamura ..... G03G 15/6505 399/397
9,207,620 B2 * 12/2015 Okumura ..... G03G 21/1652
10,919,720 B2 * 2/2021 Fuchi ..... B65H 5/38
2006/0248733 A1 * 11/2006 Masai ..... G03G 21/1652 30/377
2019/0300320 A1 * 10/2019 Fuchi ..... B65H 29/60
2021/0309475 A1 * 10/2021 Kakuta ..... B65H 5/38

FOREIGN PATENT DOCUMENTS

JP 58006872 A * 1/1983 ..... B65H 29/50
JP 2008-001516 1/2008

* cited by examiner

*Primary Examiner* — Howard J Sanders
(74) *Attorney, Agent, or Firm* — Gerald E. Hespos; Michael J. Porco

(57) ABSTRACT

A relay conveyance device includes a discharge unit which discharges a sheet toward a carry-in port, a decurling unit attached to the discharge unit, and a discharge adjustment mechanism capable of adjusting a height direction inclination of the discharge unit. The discharge adjustment mechanism is set to be capable of adjusting an inclination of the discharge unit such that the decurling unit maintains a predetermined reference position even when the discharge unit is supported by any of a plurality of unit supporting portions set according to a height position of the carry-in port.

10 Claims, 16 Drawing Sheets

RELAY CONVEYANCE DEVICE, IMAGE FORMING SYSTEM, COMBINATION OF IMAGE FORMING SYSTEM, AND SHEET CONVEYANCE DEVICE

INCORPORATION BY REFERENCE

The present application claims priority from Japanese Patent Application No. 2019-087426 filed on May 7, 2019, disclosure of which is all incorporated herein.

BACKGROUND

Field of the Invention

The present invention relates to a relay conveyance device which relays conveyance of a sheet from an image forming device to a post-processing device, an image forming system including the relay conveyance device, a combination of an image forming system, and sheet conveyance device.

Related Art

There is a known image forming system including an image forming device which forms an image on a sheet, a post-processing device which conducts predetermined post-processing for a sheet on which an image has been formed, and a relay conveyance device which is arranged between the image forming device and the post-processing device to relay conveyance of a sheet between both the devices. Examples of the post-processing device include a finisher which applies perforation processing to a sheet, staple processing, and the like, and a stacker which stacks and houses a large number of sheets. The relay conveyance device includes a discharge unit which discharges a sheet fed out from the image forming device toward the post-processing device.

Some kinds of post-processing devices have, at different height positions, carry-in ports into which sheets are carried. For example, a finisher has a carry-in port formed at a position higher than that of a carry-in port of a stacker. As a method of conveyancing a sheet to a carry-in port at a different height position, a post-processing device including a height adjustment base is known.

SUMMARY

A relay conveyance device according to one aspect of the present invention is a device arranged between an image forming device which forms an image on a sheet and one post-processing device applying predetermined post-processing to a sheet to relay conveyance of a sheet from the image forming device to the post-processing device, the post-processing device having a carry-in port which allows carry-in of a sheet. The relay conveyance device includes a device main body in which a relay conveyance path is provided as a conveyance path of a sheet fed out from the image forming device; a plurality of unit supporting portions provided, at a downstream end of the device main body in a sheet conveying direction, at positions different from each other in the height direction; a discharge unit supported by any one of the plurality of unit supporting portions to receive a sheet having passed through the relay conveyance path and discharge the sheet toward the carry-in port; a processing unit attached to the discharge unit to apply predetermined processing to the sheet; a processing unit adjustment portion capable of adjusting a height direction inclination of the processing unit relative to a sheet width direction orthogonal to both the height direction and the sheet conveying direction such that the processing unit maintains a horizontal reference position in a state where the processing unit is attached to the discharge unit; and a discharge unit adjustment mechanism capable of adjusting an inclination in the height direction of the discharge unit relative to the sheet width direction such that the processing unit adjusts the reference position in a state where in each of the plurality of unit supporting portions, the processing unit is supported by the discharge unit.

An image forming system according to another aspect of the present invention includes an image forming device which forms an image on a sheet; a post-processing device having a carry-in port which allows carry-in of a sheet and applying predetermined post-processing to a sheet; and the relay conveyance device arranged between the image forming device and the post-processing device to relay conveyance of a sheet from the image forming device to the post-processing device.

A combination of an image forming system according to a further aspect of the present invention includes an image forming device which forms an image on a sheet; a plurality of kinds of post-processing devices each capable of applying predetermined post-processing to a sheet and each having a carry-in port which allows carry-in of a sheet and which has a position in a height direction different from each other; and the relay conveyance device according to claim 1 arranged between the image forming device and one post-processing device selected from the plurality of kinds of post-processing devices to relay conveyance of a sheet from the image forming device to the one post-processing device.

A sheet conveyance device according to a further aspect of the present invention is a device arranged on an upstream side of a post-processing device which applies predetermined post-processing to the sheet, to convey the sheet to the post-processing device, the post-processing device having a carry-in port which allows carry-in of a sheet, the sheet conveyance device includes a device main body in which a conveyance path is provided; a plurality of unit supporting portions provided, at a downstream end of the device main body in a sheet conveying direction, at positions different from each other in the height direction; a discharge unit supported by any one of the plurality of unit supporting portions to receive a sheet having passed through the conveyance path and discharge the sheet toward the carry-in port; a processing unit attached to the discharge unit to apply predetermined processing to the sheet; a processing unit adjustment portion capable of adjusting a height direction inclination of the processing unit relative to a sheet width direction orthogonal to both the height direction and the sheet conveying direction such that the processing unit takes a horizontal reference position in a state where the processing unit is attached to the discharge unit; and a discharge unit adjustment mechanism capable of adjusting an inclination in the height direction of the discharge unit relative to the sheet width direction such that the processing unit adjusts the reference position in a state where in each of the plurality of unit supporting portions, the processing unit is supported by the discharge unit.

DETAILED DESCRIPTION

In the following, a relay conveyance device (sheet conveyance device), an image forming system, and a combination of an image forming system according to an embodiment of the present invention will be described based on the drawings.

Figure 1:
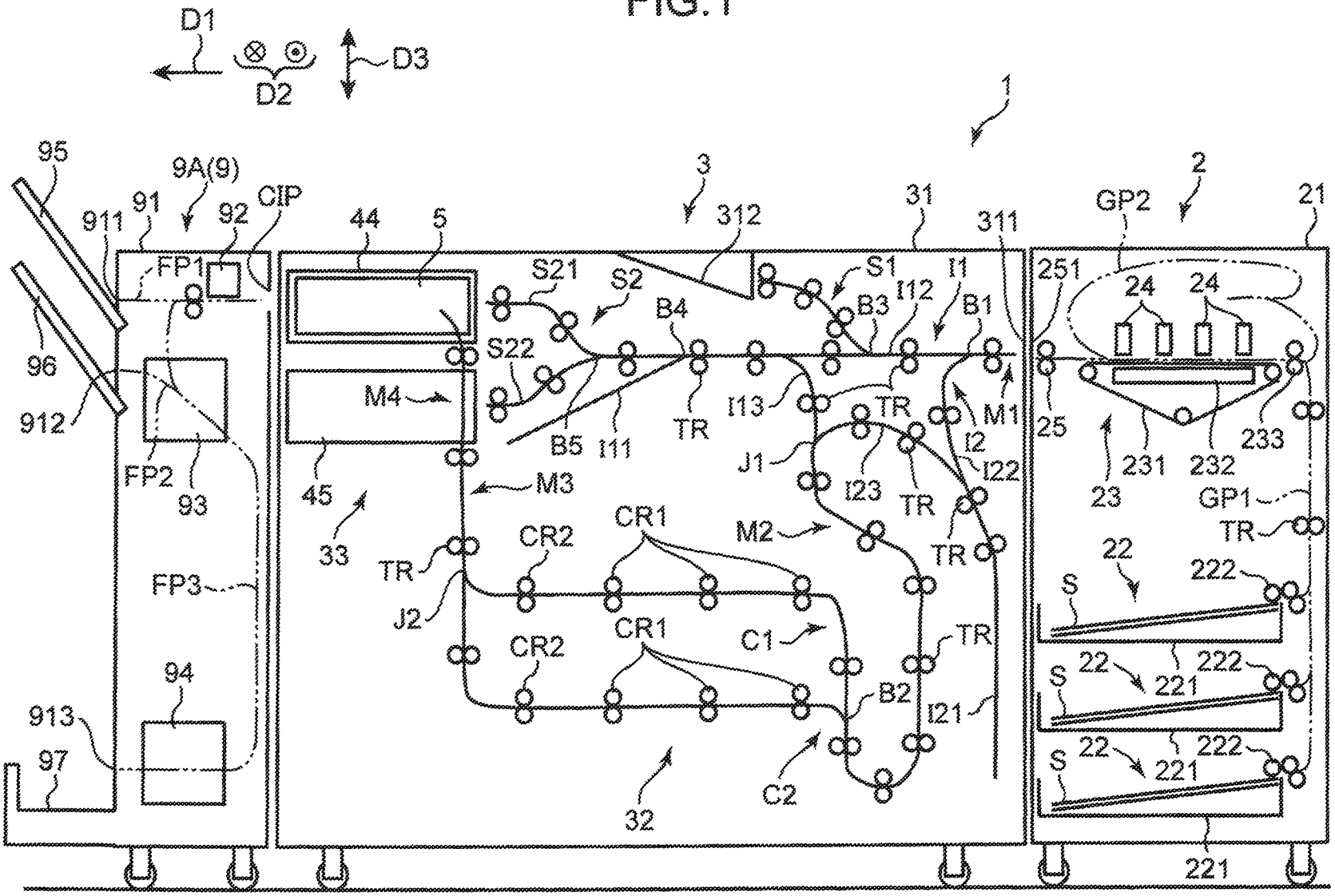
FIG. 1 is a view showing an internal structure of an image forming system to which a relay conveyance device according to one embodiment of the present invention is applied, which shows a state where a finisher is coupled as a post-processing device.
Figure 2:
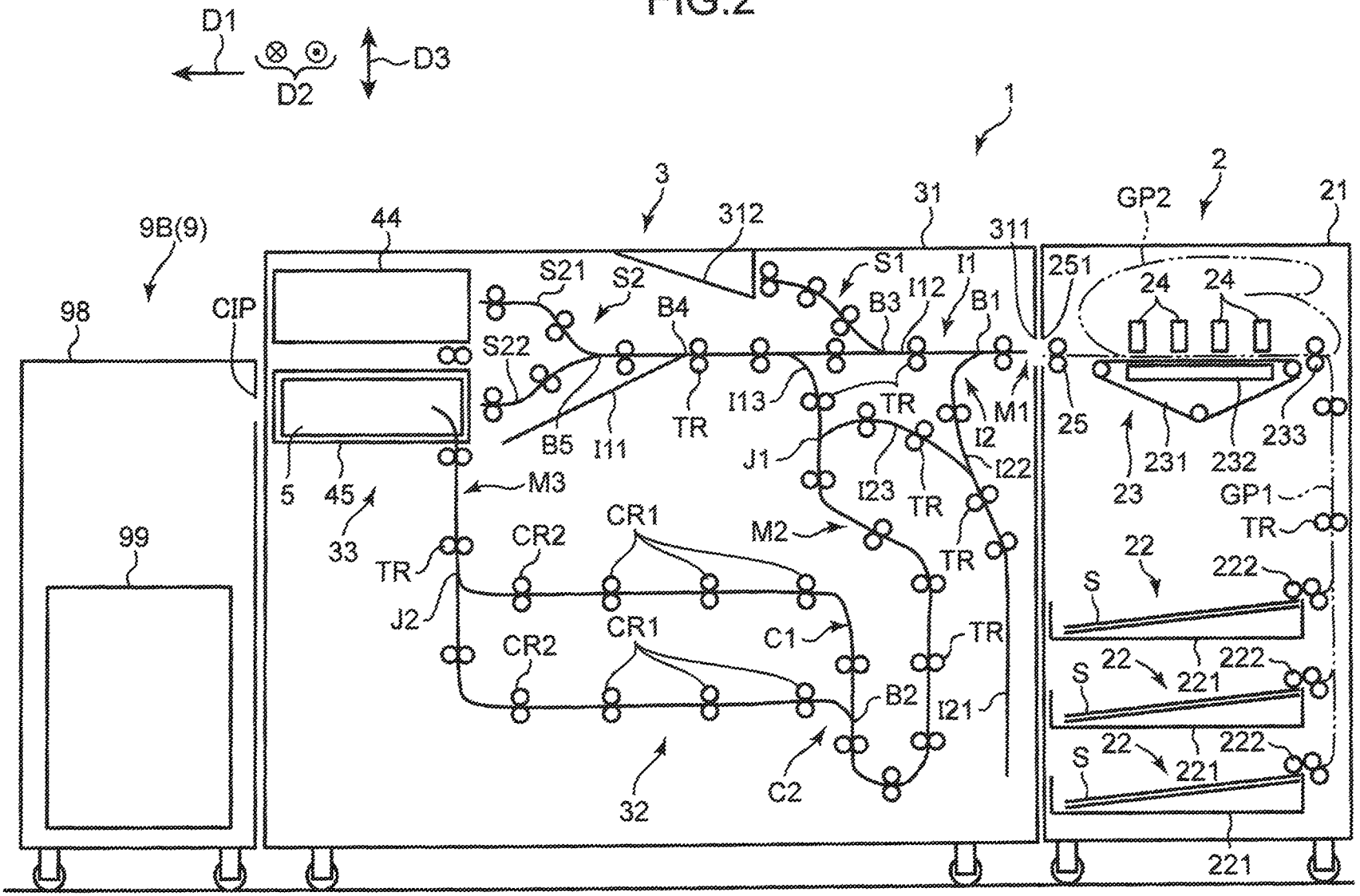
FIG. 2 is a view showing an internal structure of the image forming system, which shows a state where a stacker is coupled as the post-processing device.

FIG. 1 and FIG. 2 are views showing an internal structure of an image forming system 1 to which a relay conveyance device 3 is applied according to one embodiment of the present invention. The image forming system 1 includes an image forming device 2, the relay conveyance device 3, and a post-processing device 9. The image forming system 1 is a system in which in the image forming device 2, an image is formed on a sheet S, in the relay conveyance device 3, the sheet S on which the image has been formed is conveyed to the post-processing device 9, and in the post-processing device 9, the sheet S is subjected to predetermined post-processing. In the following description, a direction on a horizontal surface of the sheet S, the direction representing a conveying direction of the sheet S, will be referred to as a "sheet conveying direction D1", and a direction orthogonal to the sheet conveying direction D1, the direction representing a width of the sheet S, will be referred to as a "sheet width direction D2". Additionally, a direction orthogonal to both the sheet conveying direction D1 and the sheet width direction D2 and vertically extending and representing a height of each device configuring the image forming system 1 will be referred to as a "height direction D3".

The image forming device 2 is a device which forms an image on the sheet S. Although an image forming method of the image forming device 2 is not particularly limited, an ink jet method is adopted in the example shown in FIG. 1 and FIG. 2. The image forming device 2 includes a device main body 21, a sheet feeding portion 22, a sheet conveyance portion 23, an image forming portion 24, and a sheet ejecting portion 25.

The device main body 21 is a box-shaped casing which houses each kind of device for forming an image on the sheet S. In the device main body 21, a first conveyance path GP1 and a second conveyance path GP2 are formed as conveyance paths of the sheet S. The first conveyance path GP1 is a conveyance path passing from the sheet feeding portion 22 to the sheet ejecting portion 25 through the image forming portion 24. The second conveyance path GP2, which is a conveyance path that reverses the back and front of the sheet S, branches from the first conveyance path GP1 on a downstream side of the image forming portion 24 in the conveying direction D1 of the sheet S and joins with the first conveyance path GP1 on an upstream side of the image forming portion 24.

The sheet feeding portion 22 feeds the sheet S to the first conveyance path GP1. The sheet feeding portion 22 includes a sheet feeding cassette 221 and a pickup roller 222. The sheet feeding cassette 221 is detachable from the device main body 21 and internally houses the sheet S. The pickup roller 222 draws out an uppermost sheet S of a bundle of the sheets housed in the sheet feeding cassette 221 one by one and sends out the sheet to the first conveyance path GP1.

The sheet S fed to the first conveyance path GP1 is conveyed to a resist roller pair 233 of the sheet conveyance portion 23 by a conveyance roller pair TR provided in the first conveyance path GP1. The resist roller pair 233 conducts skew correction of the sheet S and also sends out the sheet S toward a conveyance belt 231 at timing of image forming processing by the image forming portion 24. Upon having a front end portion come into contact with an outer circumferential surface of the conveyance belt 231, the sheet S sent out by the resist roller pair 233 is conveyed in the sheet conveying direction D1 while being held on the outer circumferential surface by driving by the conveyance belt 231.

The sheet conveyance portion 23 is arranged below the image forming portion 24 in the height direction D3 so as to be opposed to the image forming portion 24. The sheet conveyance portion 23 includes the conveyance belt 231 and a suction portion 232. The conveyance belt 231 holds, on the outer circumferential surface thereof, the sheet S sent out by the resist roller pair 233 and circulates while holding the sheet S to conveyance the sheet in the sheet conveying direction D1. The conveyance belt 231 has a plurality of suction holes extending from the outer circumferential surface to an inner circumferential surface of the belt in a thickness direction. The suction portion 232 is arranged so as to be opposed to the inner circumferential surface of the conveyance belt 231. The suction portion 232 brings the sheet S into close contact with the outer circumferential surface of the conveyance belt 231 by generating a negative pressure between the sheet S held on the outer circumferential surface of the conveyance belt 231 and the conveyance belt 231. The suction portion 232 generates suction force by sucking air from a space above the conveyance belt 231 through the suction holes of the conveyance belt 231. The suction force generates, in a space above the conveyance belt 231, an air flow (suction air) directed to the suction portion 232. When the sheet S covers a part of the outer circumferential surface of the conveyance belt 231, suction force (negative pressure) acts on the sheet S to bring the sheet S into close contact with the outer circumferential surface of the conveyance belt 231.

The image forming portion 24 is arranged above the sheet conveyance portion 23 so as to be opposed to the outer circumferential surface of the conveyance belt 231. The image forming portion 24 forms an image by applying the image forming processing to the sheet S, the sheet S being conveyed in the sheet conveying direction D1 while being held on the outer circumferential surface of the conveyance belt 231. In the present embodiment, the image forming portion 24, using an ink jet method as an image forming method, forms an image on the sheet S by jetting an ink. The image forming portion 24 is configured with a recording head which jets an ink. In the examples shown in FIG. 1 and FIG. 2, the image forming portion 24 is configured with four recording heads which jet color inks of yellow, magenta, cyan, and black, respectively.

The sheet S on which an image has been formed by the image forming portion 24 is discharged toward the relay conveyance device 3 through a sheet ejecting port 251 by the sheet ejecting portion 25 provided at a downstream end of the first conveyance path GP1. On the other hand, in a case where the sheet S having passed through the image forming portion 24 is for double-sided printing and has a first face (a front face) thereof finished with the image forming processing, the sheet S is sent out to the second conveyance path GP2 to have its back and front reversed. The sheet S having been conveyed through the second conveyance path GP2 is again supplied onto the outer circumferential surface of the conveyance belt 231 while having its back and front reversed via the resist roller pair 233. The sheet S supplied to the conveyance belt 231 with its back and front reversed in this manner has its second face (a back face), which is reverse to the first face, subjected to the image forming processing by the image forming portion 24 while being conveyed by the conveyance belt 231. The sheet S finished with the double-sided printing is discharged by the sheet ejecting portion 25 toward the relay conveyance device 3 through the sheet ejecting port 251.

The relay conveyance device 3 (sheet conveyance device) is arranged between the image forming device 2 and the post-processing device 9 in the sheet conveying direction D1. In other words, the relay conveyance device 3 is arranged on a downstream side of the image forming device 2 and an upstream side of the post-processing device 9 in the sheet conveying direction D1. The relay conveyance device 3 is a device which relays conveyance of the sheet S from the image forming device 2 to the post-processing device 9. The relay conveyance device 3 receives, from a receiving port 311, the sheet S discharged from the sheet ejecting port 251 of the image forming device 2 and discharges the sheet S toward the post-processing device 9. Details of the relay conveyance device 3 will be described later.

The post-processing device 9 is a device which subjects the sheet S on which an image has been formed to predetermined post-processing, the sheet S being discharged from the relay conveyance device 3. As the post-processing device 9, there are provided a plurality of kinds of devices each having a carry-in port CIP into which the sheet S is carried, each carry-in port CIP being different from each other in position in the height direction D3. In the image forming system 1, one post-processing device selected from the plurality of kinds of the post-processing devices 9 is coupled to a downstream side of the relay conveyance device 3. In FIG. 1, a finisher 9A is illustrated as the post-processing device 9 coupled to the relay conveyance device 3. The finisher 9A is a post-processing device which selectively applies perforation processing to the sheet S, staple processing, and saddle folding processing. In FIG. 2, a stacker 9B is illustrated as the post-processing device 9 coupled to the relay conveyance device 3. The stacker 9B is a post-processing device which houses a large number of sheets S. A system including the image forming device 2, the finisher 9A, the stacker 9B, and the relay conveyance device 3 configures a combination of an image forming system according to the present invention. The relay conveyance device 3 is arranged between the post-processing device, which is either the finisher 9A or the stacker 9B, and the image forming device 2.

The finisher 9A (the post-processing device 9) shown in FIG. 1 includes a device main body 91, a perforation device 92 housed in the device main body 91, a staple device 93, and a saddle folding device 94. In the device main body 91, the perforation device 92 is arranged in an upper portion, the staple device 93 is arranged in a middle portion, and the saddle folding device 94 is arranged in a lower portion in the height direction D3.

In a side surface of the device main body 91 at an upstream side in the sheet conveying direction D1, the side surface being opposed to the relay conveyance device 3, there is formed the carry-in port CIP into which the sheet S discharged from the relay conveyance device 3 is carried. Also in a side surface of the device main body 91 opposite to the relay conveyance device 3, a first discharge port 911 is formed at the side of the perforation device 92, a second discharge port 912 is formed at the side of the staple device 93, and a third discharge port 913 is formed at the side of the saddle folding device 94.

In the device main body 91, a first conveyance path FP1, a second conveyance path FP2, and a third conveyance path FP3 are formed. The first conveyance path FP1 is a conveyance path directed from the carry-in port CIP toward the first discharge port 911 through the perforation device 92. The second conveyance path FP2 is a conveyance path which branches, on a downstream side of the perforation device 92, from the first conveyance path FP1 and passes through the staple device 93 toward the second discharge port 912. The third conveyance path FP3 is a conveyance path which branches from the second conveyance path FP2 and passes through the saddle folding device 94 toward the third discharge port 913.

The sheet S discharged from the relay conveyance device 3 is carried from the carry-in port CIP into the device main body 91 and introduced into the first conveyance path FP1. It is assumed that in the finisher 9A, the sheet S is subjected to the perforation processing. In this case, the sheet S is conveyed to the perforation device 92 through the first conveyance path FP1. The perforation device 92 applies the perforation processing to the sheet S. The sheet S after being subjected to the perforation processing passes through the first conveyance path FP1 so as to be discharged from the first discharge port 911 and stacked in a first discharge tray 95. It is assumed that in the finisher 9A, the staple processing is conducted. In this case, the sheet S is conveyed from the first conveyance path FP1 to the staple device 93 along the second conveyance path FP2. The staple device 93 applies the staple processing to the sheet S. The sheet S after being subjected to the staple processing passes through the second conveyance path FP2 so as to be discharged from the second discharge port 912 and stacked in a second discharge tray 96.

It is assumed that in the finisher 9A, the saddle folding processing is conducted. In this case, the sheet S is conveyed from the first conveyance path FP1 to the saddle folding device 94 along the second conveyance path FP2 and the third conveyance path FP3. The saddle folding device 94 conducts the saddle folding processing of saddle-stitching and saddle-folding the sheet S. The sheet S having been subjected to the saddle folding processing passes through the third conveyance path FP3 and is discharged from the third discharge port 913 and stacked in a third discharge tray 97.

The stacker 9B (the post-processing device 9) shown in FIG. 2 includes a device main body 98 and a large capacity tray 99 housed in the device main body 98. In a side surface of the device main body 98 at an upstream side in the sheet conveying direction D1, the side surface being opposed to the relay conveyance device 3, there is formed the carry-in port CIP into which the sheet S discharged from the relay conveyance device 3 is carried. The large capacity tray 99 accumulates and houses the sheets S carried into the device main body 98 from the carry-in port CIP. In general, a position (height position) of the carry-in port CIP of the stacker 9B in the height direction D3 is lower than a height position of the carry-in port CIP of the finisher 9A.

Next, the relay conveyance device 3 will be detailed. The relay conveyance device 3 is provided separately from the image forming device 2 and the post-processing device 9 and is coupled to each of the image forming device 2 and the post-processing device 9. The relay conveyance device 3 is capable of selectively conducting the back and front inversion of the sheet S and the position correction of the sheet S in the sheet width direction D2 while relaying conveyance of the sheet S from the image forming device 2 to the post-processing device 9.

The relay conveyance device 3 includes a device main body 31, a relay conveyance path 32 provided within the device main body 31, and a sheet discharge portion 33.

In a side surface of the device main body 31 at an upstream side in the sheet conveying direction D1, the side surface being opposed to the image forming device 2, there is formed the receiving port 311 which receives the sheet S discharged from the sheet ejecting port 251 of the image forming device 2. A position (height position) of the receiving port 311 in the height direction D3 is same as a height position of the sheet ejecting port 251. "A height position is same" represents a state where a difference in height position between the receiving port 311 and the sheet ejecting port 251 is within a predetermined allowable range.

The sheet S received through the receiving port 311 into the device main body 31 is introduced to the relay conveyance path 32 (conveyance path). The relay conveyance path 32 is a conveyance path directed from the receiving port 311 to the sheet discharge portion 33. At each portion of the relay conveyance path 32, the conveyance roller pair TR which conveyances the sheet S is provided. The relay conveyance path 32 has, from its upstream side in the sheet conveying direction D1, a first common path M1, a first inversion path I1 and a second inversion path I2, a second common path M2, a first correction path C1 and a second correction path C2, a third common path M3, and a fourth common path M4 in this order. The first inversion path I1 and the second inversion path I2 are inversion portions which reverse the back and front of the sheet S. The first correction path C1 and the second correction path C2 are correction portions which correct a position of the sheet S in the sheet width direction D2.

The first common path M1 extends substantially horizontally from the receiving port 311 and branches at a first branch point B1 into the first inversion path I1 and the second inversion path I2.

The first inversion path I1 has a switch back path I11 in which a sheet conveying direction is inverted, a forward path I12 in which the sheet S is conveyed to the switch back path I11, and a backward path I13 in which the switched back sheet S is conveyed. The forward path I12 extends substantially horizontally from the first branch point B1 to a downstream side in the sheet conveying direction D1. The switch back path I11 slants to extend downward from an exit of the forward path I12. The backward path I13 extends downward from an entrance of the switch back path I11.

The second inversion path I2 has a switch back path I21 in which the conveying direction of the sheet S is inverted, a forward path I22 in which the sheet S is conveyed to the switch back path I21, and a backward path I23 in which a switched back sheet S is conveyed. The forward path I22 extends downward from the first branch point B1. The switch back path I21 extends downward from an exit of the forward path I22. The backward path I23 extends from an entrance of the switch back path I21 to the downstream side of the sheet conveying direction D1.

The backward path I13 of the first inversion path I1 and the backward path I23 of the second inversion path I2 join at a first joining point J1. After extending downward from the first joining point J1, the second common path M2 is folded back upward while curving. The second common path M2 branches at a second branch point B2 into the first correction path C1 and the second correction path C2.

The first correction path C1 and the second correction path C2 are formed vertically in line and extend in a substantially horizontal direction. The first correction path C1 and the second correction path C2 are each provided with three pairs of switching rollers CR1 and a correction roller pair CR2 sequentially from the upstream side. An upper roller of each switching roller pair CR1 is movable in the height direction D3 between a nip position at which the upper roller sandwiches the sheet S with a lower roller and a nip releasing position upwardly spaced apart from the sheet S. The correction roller pair CR2 is movable in the sheet width direction D2.

The first correction path C1 and the second correction path C2 join at a second joining point J2. The third common path M3 extends upward from the second joining point J2. An exit of the third common path M3 is connected to a discharge unit 5 when the discharge unit 5 is supported by a second unit supporting portion 45 in the sheet discharge portion 33 to be described later (see FIG. 2). The fourth common path M4 extends further upwardly from the third common path M3. An exit of the fourth common path M4 is connected to the discharge unit 5 when the discharge unit 5 is supported by a first unit supporting portion 44 in the sheet discharge portion 33 to be described later (see FIG. 1).

The relay conveyance path 32 further has a first sub-path S1 and a second sub-path S2. The first sub-path S1 is a conveyance path in which the sheet S not requiring inversion and position correction, and the post-processing is conveyed. The second sub-path S2 is a conveyance path in which the sheet S not requiring inversion and position correction, and requiring only the post-processing is conveyed. The first sub-path S1 branches upward at a third branch point B3 in the middle of the forward path I12 of the first inversion path I1 to extend toward a discharge tray 312. The second sub-path S2 branches at a fourth branch point B4 in the middle of the switch back path I11 of the first inversion path I1 to extend toward the sheet discharge portion 33. The second sub-path S2 branches at a fifth branch point B5 into an upper path S21 and a lower path S22. The upper path S21 extends toward the first unit supporting portion 44 in the sheet discharge portion 33. The lower path S22 extends toward the second unit supporting portion 45 in the sheet discharge portion 33.

Figure 3:
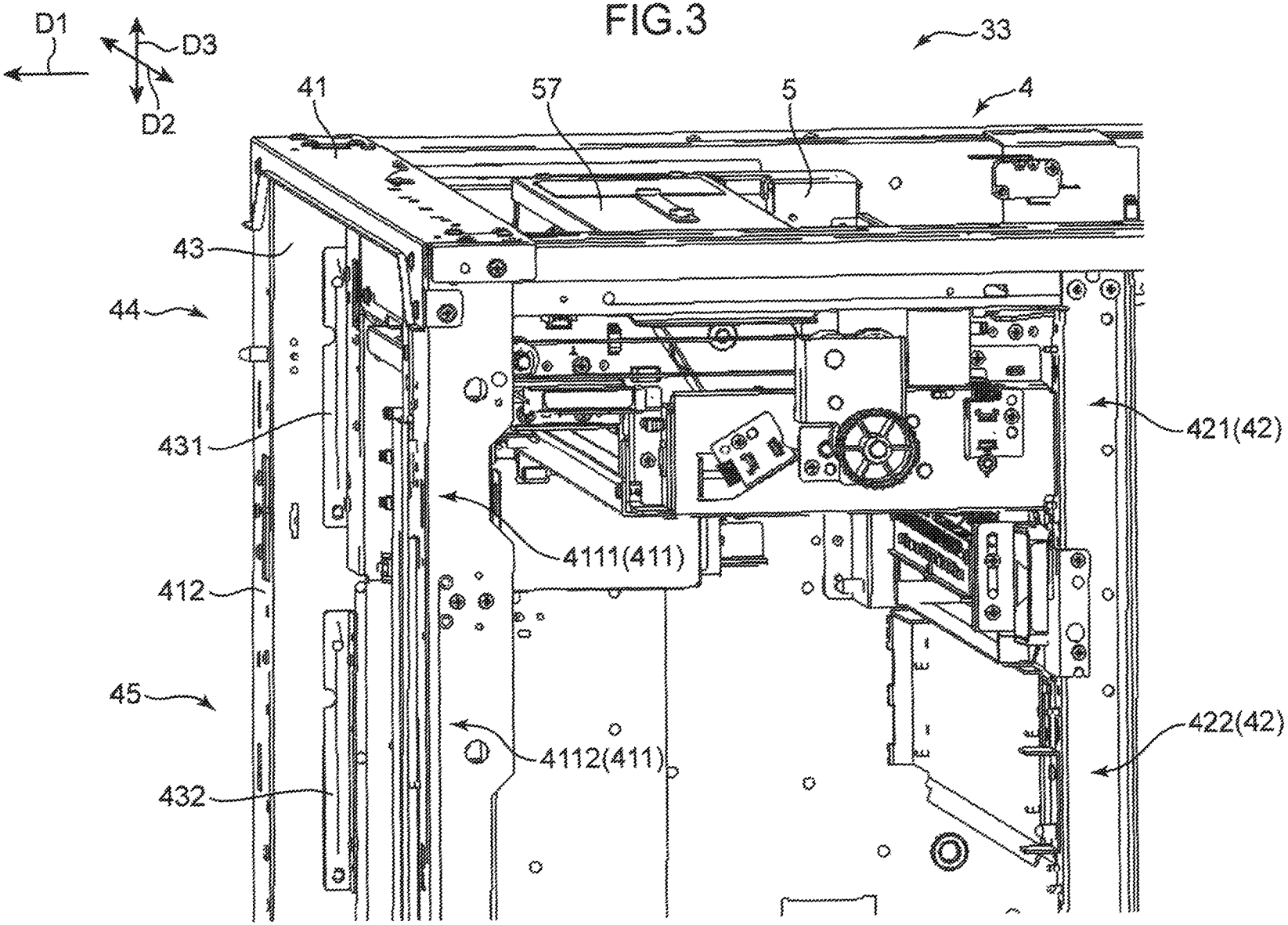
FIG. 3 is a perspective view showing a configuration of a sheet discharge portion in the relay conveyance device, the view showing a state where a discharge unit is supported by a first unit supporting portion.
Figure 4:
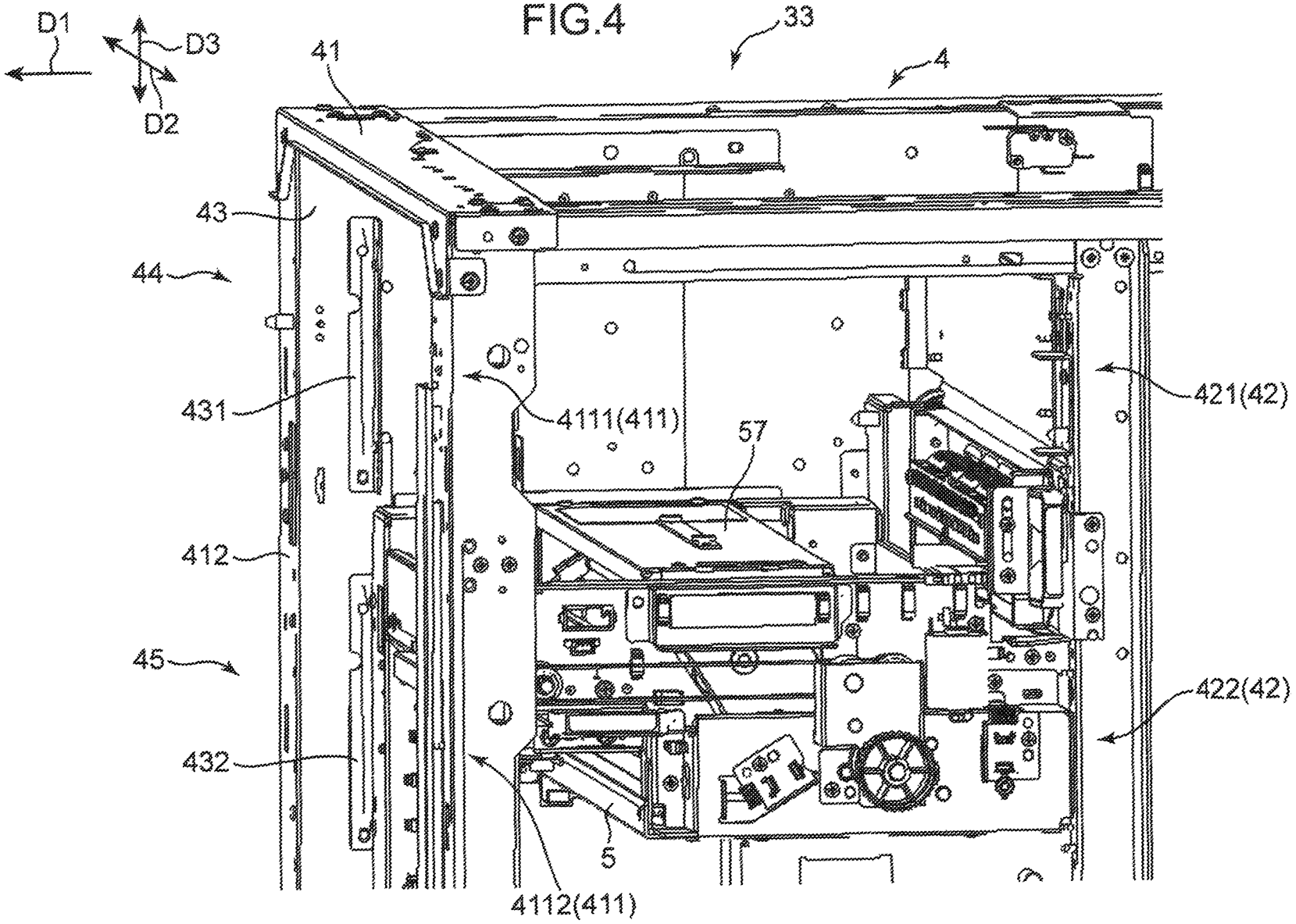
FIG. 4 is a perspective view showing a configuration of the sheet discharge portion in the relay conveyance device, the view showing a state where the discharge unit is supported by a second unit supporting portion.
Figure 5:
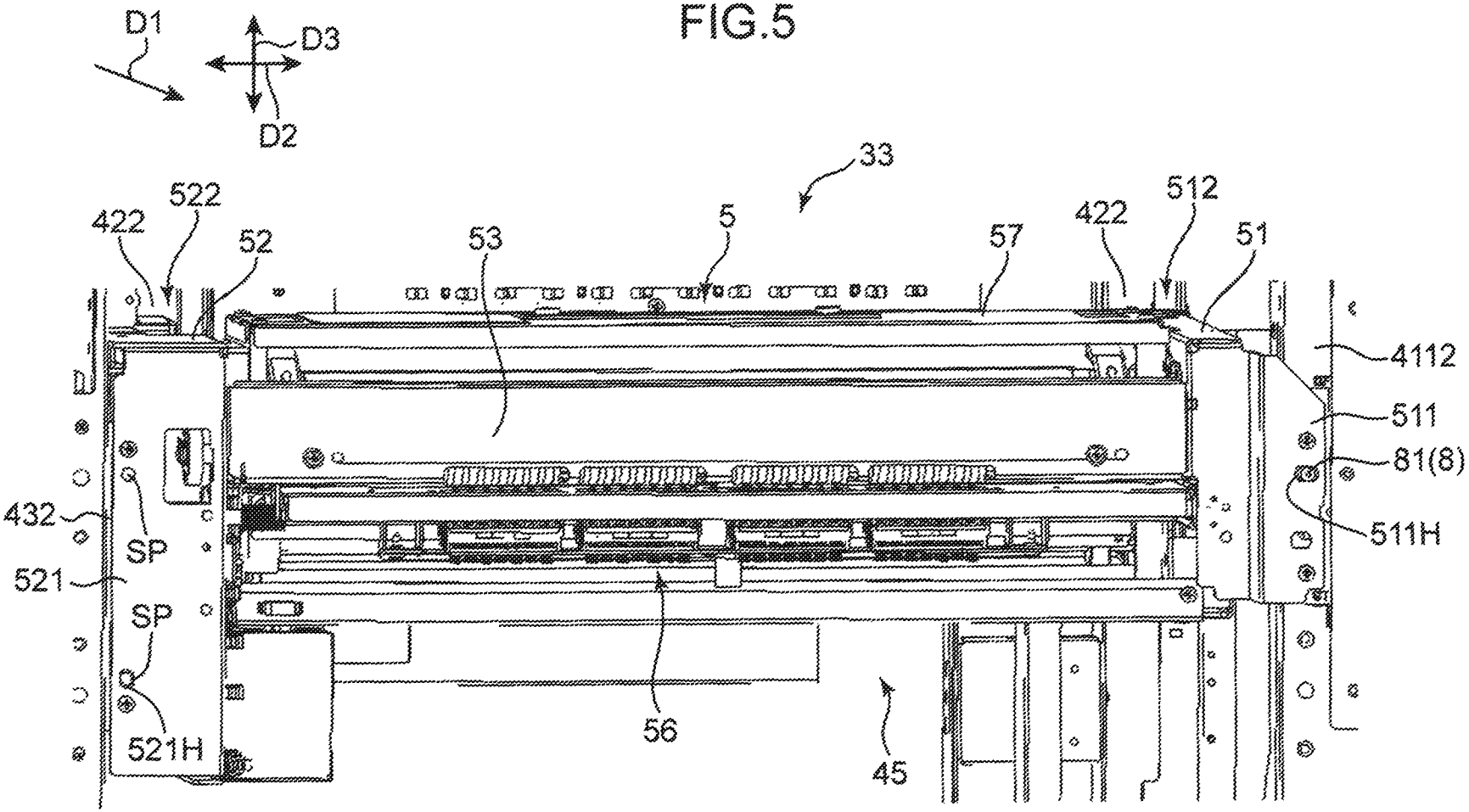
FIG. 5 is a perspective view showing a supported state of the discharge unit in the second unit supporting portion.

The sheet S discharged from the image forming device 2 and having passed through the relay conveyance path 32 is introduced to the sheet discharge portion 33. The sheet discharge portion 33 is arranged at a downstream end of the device main body 31 in the sheet conveying direction D1. The sheet discharge portion 33 will be described with reference to FIG. 3 to FIG. 5 in addition to FIG. 1 and FIG. 2. FIG. 3 and FIG. 4 are perspective views showing a configuration of the sheet discharge portion 33 in the relay conveyance device 3. FIG. 5 is a perspective view showing a supported state of the discharge unit 5 in the second unit supporting portion 45 of the sheet discharge portion 33.

The sheet discharge portion 33 is configured to include a discharge portion main body 4, the discharge unit 5, a decurling unit 57 (a processing unit), and a discharge adjustment mechanism 8.

The discharge portion main body 4 forms a portion of the downstream end of the device main body 31 in the sheet conveying direction D1. The discharge portion main body 4 is a structure for defining the first unit supporting portion 44 and the second unit supporting portion 45 provided corresponding to positions (height positions) of the respective carry-in ports CIP for the plurality of kinds of post-processing devices 9 in the height direction D3. The discharge portion main body 4 has a first frame body 41 and a second frame body 42.

The first frame body 41 is formed to have a rectangular frame shape with an opening at the center thereof and defines a downstream side end portion of the discharge portion main body 4 in the sheet conveying direction D1. The first frame body 41 has a first side pillar 411 and a second side pillar 412 which are arranged to be opposed to and spaced apart from each other by a predetermined interval in the sheet width direction D2 and which extend in the height direction D3. The first side pillar 411 is zoned into a first side pillar upper portion 4111 on an upper side and a first side pillar lower portion 4112 on a lower side in the height direction D3. To the second side pillar 412, a side surface board 43 extending to the second frame body 42 is attached. To a downstream end portion of the side surface board 43 in the sheet conveying direction D1, a first supporting member 431 is fixed at a position, in the height direction D3, corresponding to the first side pillar upper portion 4111 and a second supporting member 432 is fixed at a position, in the height direction D3, corresponding to the first side pillar lower portion 4112.

The second frame body 42 is formed to have a rectangular frame shape with an opening at the center thereof and defines an upstream side end portion of the discharge portion main body 4 in the sheet conveying direction D1. The second frame body 42 is zoned into an upper side second frame body upper portion 421 and a lower side second frame body lower portion 422 in the height direction D3.

The first unit supporting portion 44 is configured to include the first side pillar upper portion 4111 and the first supporting member 431, and the second frame body upper portion 421. In the first unit supporting portion 44, a downstream end portion in the sheet conveying direction D1 is configured with the first side pillar upper portion 4111 and the first supporting member 431, and an upstream end portion in the sheet conveying direction D1 is configured with the second frame body upper portion 421. The first unit supporting portion 44, which is a reference unit supporting portion, is provided corresponding to a position of the carry-in port CIP of the finisher 9A as the post-processing device 9 in the height direction D3 (see FIG. 1). In a case where the finisher 9A is coupled to the relay conveyance device 3, the discharge unit 5 is supported in the first unit supporting portion 44 (FIG. 3).

The second unit supporting portion 45 is configured to include the first side pillar lower portion 4112 and the second supporting member 432, and the second frame body lower portion 422. In the second unit supporting portion 45, a downstream end portion in the sheet conveying direction D1 is configured with the first side pillar lower portion 4112 and the second supporting member 432, and an upstream end portion in the sheet conveying direction D1 is configured with the second frame body lower portion 422. The second unit supporting portion 45 is provided corresponding to a position of the carry-in port CIP of the stacker 9B as the post-processing device 9 in the height direction D3 and is different from the first unit supporting portion 44 in the position in the height direction D3 (see FIG. 2). In a case where the stacker 9B is coupled to the relay conveyance device 3, the discharge unit 5 is supported in the second unit supporting portion 45 (FIG. 4).

In the sheet discharge portion 33, the number of the first unit supporting portions 44 and the number of the second unit supporting portions 45 are set according to the number of the post-processing devices 9 assumed to be coupled to the relay conveyance device 3. While one first unit supporting portion 44 is provided as the reference, at least one second unit supporting portion 45 is provided which has a position in the height direction D3 different from that of the first unit supporting portion 44. In a case, for example, where two post-processing devices 9 having the carry-in ports CIP different in a height position are assumed to be coupled, one first unit supporting portion 44 is provided, while one second unit supporting portion 45 is provided. In a case where three post-processing devices 9 having the carry-in ports CIP different in a height position are assumed to be coupled, one first unit supporting portion 44 is provided, while two second unit supporting portions 45 are provided.

The discharge unit 5 is supported by either the first unit supporting portion 44 or the second unit supporting portion 45 corresponding to the position in the height direction D3 of the carry-in port CIP of the post-processing device 9 coupled to the relay conveyance device 3. The discharge unit 5 receives the sheet S having passed through the relay conveyance path 32 (FIG. 1 and FIG. 2) and also discharges the sheet S toward the carry-in port CIP of the post-processing device 9. Additionally, as shown in FIG. 3 and FIG. 4, to the discharge unit 5, the decurling unit 57 is detachably attached. The decurling unit 57 is one example of a processing unit which subjects the sheet S received by the discharge unit 5 to predetermined processing. The decurling unit 57 is a unit which decurls the sheet S on which an image has been formed and which has passed through the relay conveyance path 32.

Figure 6:
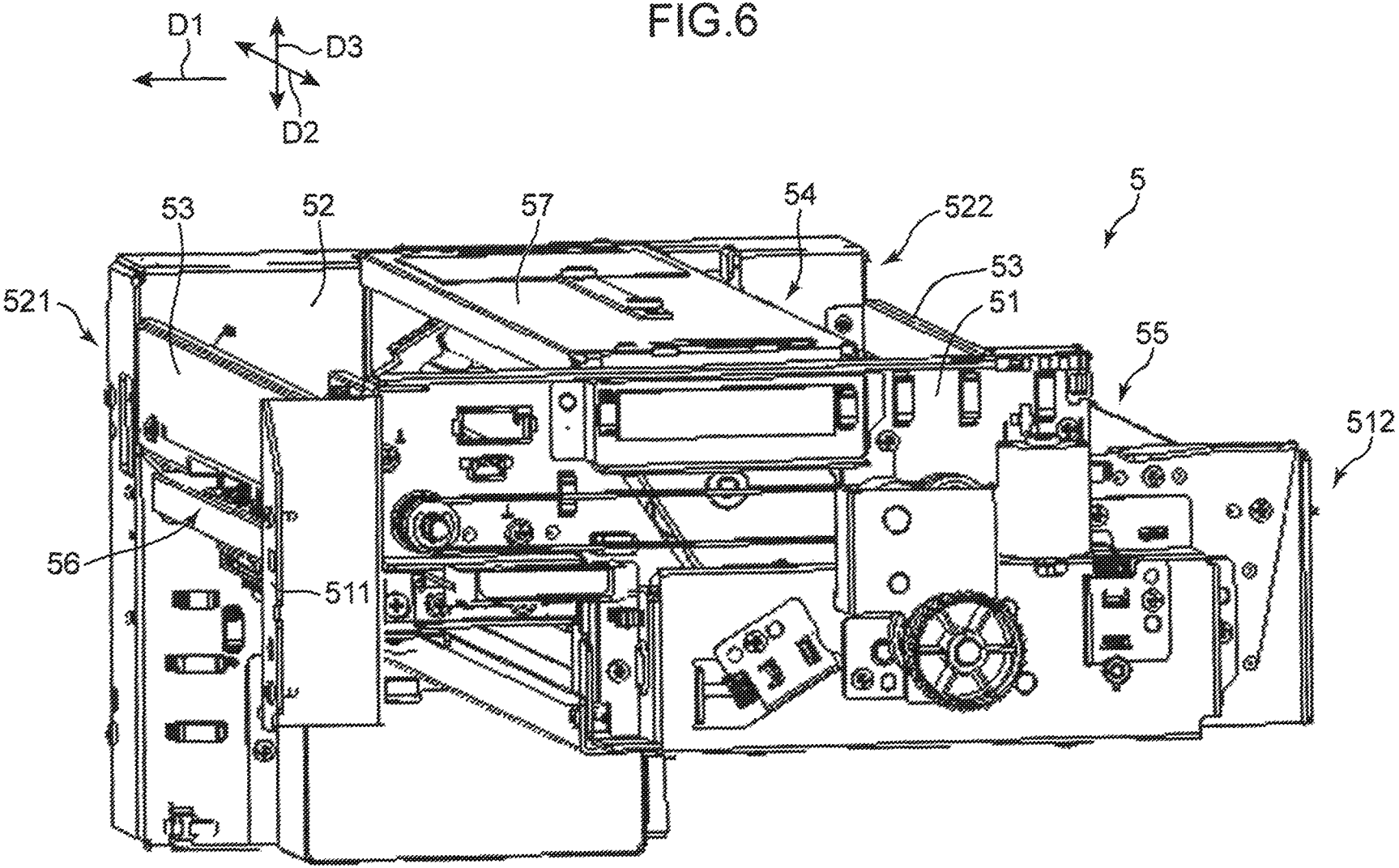
FIG. 6 is a perspective view of the discharge unit.
Figure 7:
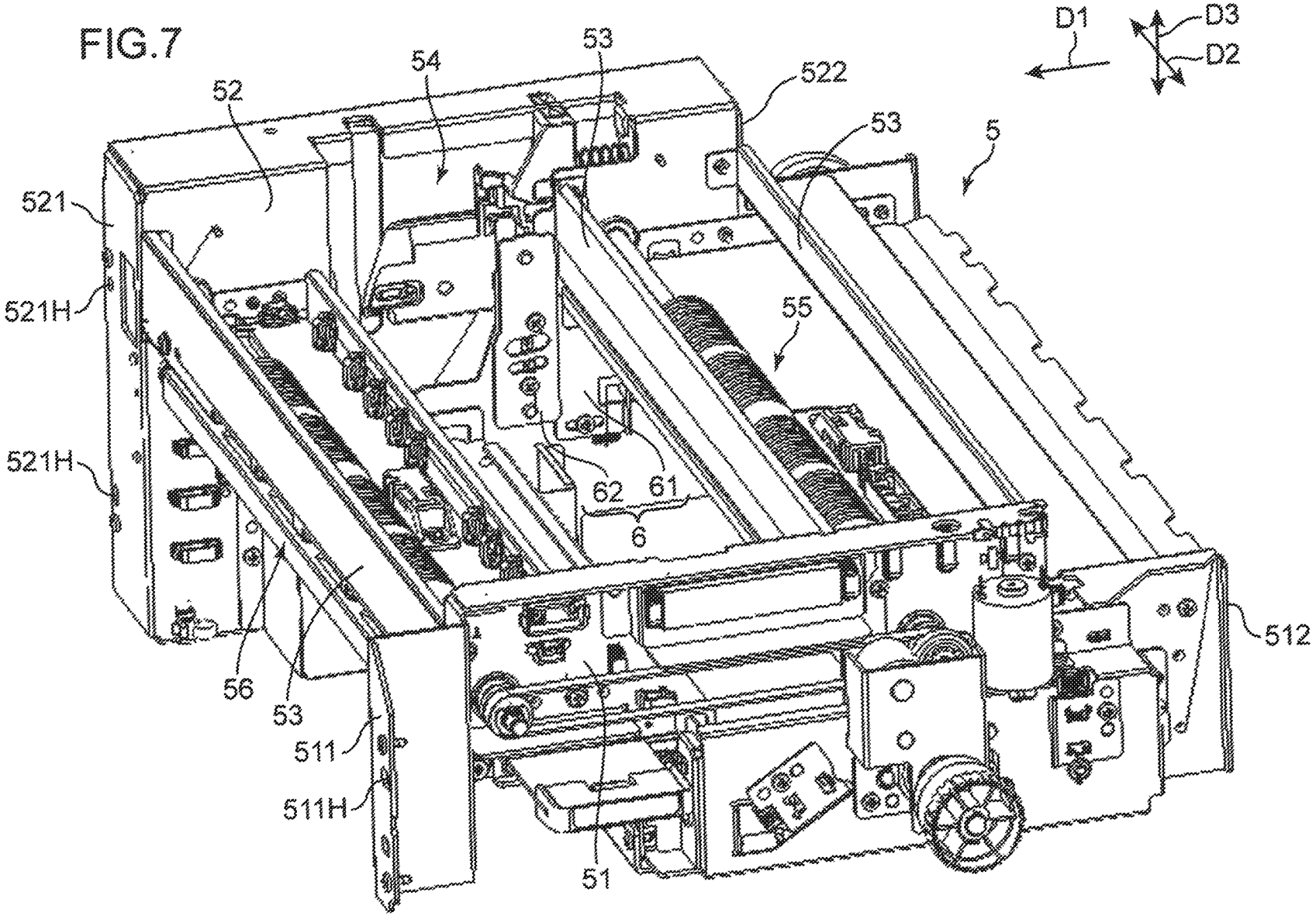
FIG. 7 is a perspective view showing a state where a decurling unit is removed from the discharge unit.
Figure 8:
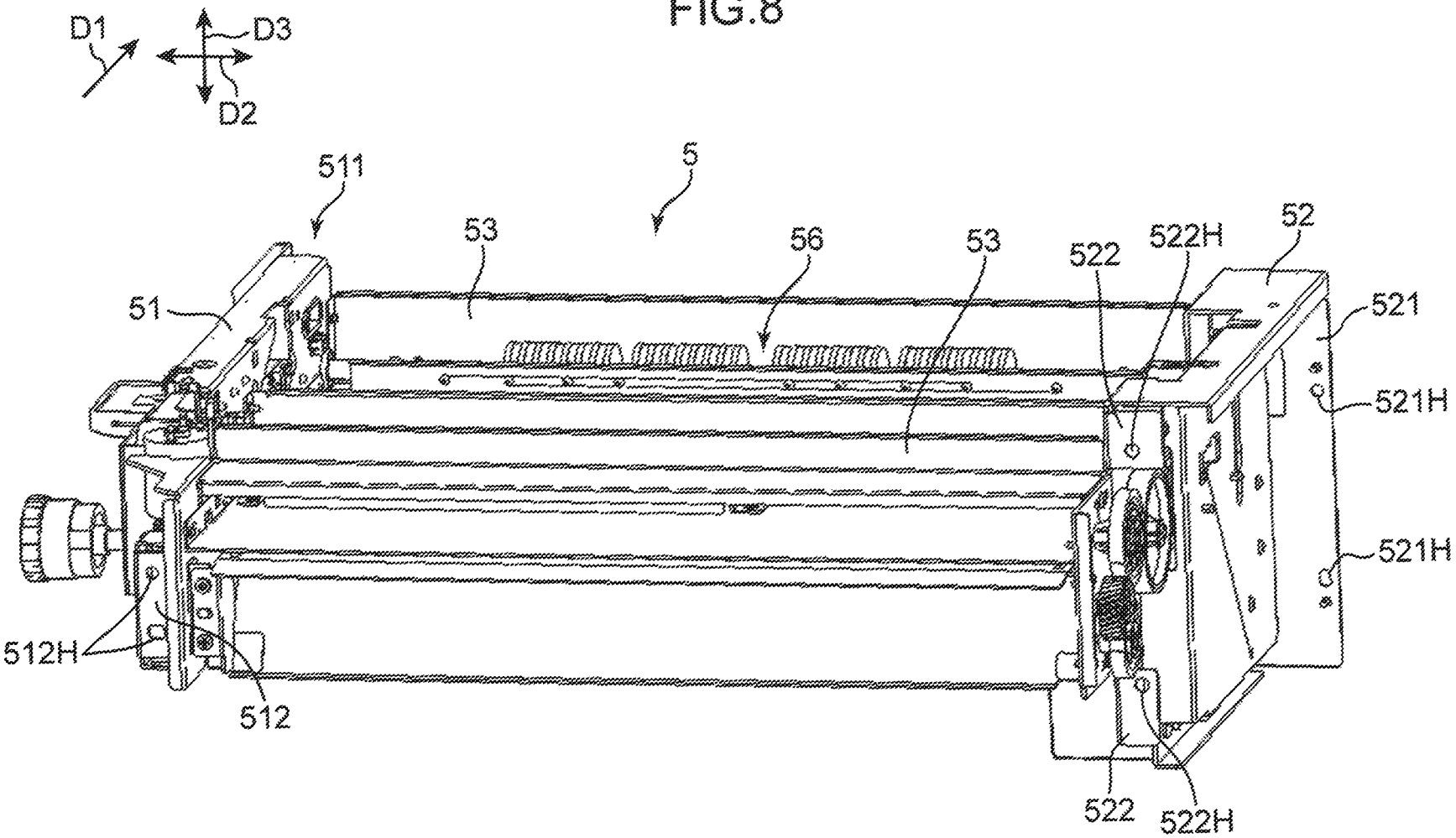
FIG. 8 is a perspective view showing the discharge unit viewed from an upstream side in a sheet conveying direction.

FIG. 6 is a perspective view of the discharge unit 5, and FIG. 7 and FIG. 8 are perspective views showing a state where the decurling unit 57 is removed from the discharge unit 5. The discharge unit 5 includes a first frame 51, a second frame 52, an attachment portion 54, a receiving portion 55, and a unit discharge portion 56.

The first frame 51 and the second frame 52 are frames which are arranged to be opposed to each other at a predetermined interval in the sheet width direction D2 and extend along the sheet conveying direction D1. The first frame 51 and the second frame 52 are connected to each other by a plurality of connecting members 53 extending in the sheet width direction D2 so as to adjust their positions in parallel to each other. In a state where the discharge unit 5 is supported by either the first unit supporting portion 44 or the second unit supporting portion 45, the first frame 51 is arranged on a side where the first side pillar 411 in the first frame body 41 is provided to stand and the second frame 52 is arranged on a side where the second side pillar 412 in the first frame body 41 is provided to stand.

The first frame 51 has a first supported portion 511 and a second supported portion 512 spaced apart from each other in the sheet conveying direction D1. In the present embodiment, in the first frame 51, the first supported portion 511 is arranged at a downstream end in the sheet conveying direction D1 and the second supported portion 512 is arranged at an upstream end in the sheet conveying direction D1. The first frame 51 is supported by either the first unit supporting portion 44 or the second unit supporting portion 45 in the first supported portion 511 and the second supported portion 512. In the first frame 51, the first supported portion 511 is provided with a first insertion hole 511H (FIG. 7) and the second supported portion 512 is provided with a second insertion hole 512H (FIG. 8).

It is assumed that the discharge unit 5 is supported by the first unit supporting portion 44. In this case, in the first frame 51, the first supported portion 511 is supported by the first side pillar upper portion 4111 in the first side pillar 411 of the first frame body 41, and the second supported portion 512 is supported by the second frame body upper portion 421 in the second frame body 42. Supporting protrusions are provided at the first side pillar upper portion 4111 and a part of the second frame body upper portion 421 corresponding to the first side pillar upper portion 4111, respectively. The first frame 51 is supported in the first unit supporting portion 44 with the supporting protrusion of the first side pillar upper portion 4111 being inserted in the first insertion hole 511H of the first supported portion 511 and the supporting protrusion of the second frame body upper portion 421 being inserted in the second insertion hole 512H of the second supported portion 512.

By contrast, it is assumed that the discharge unit 5 is supported by the second unit supporting portion 45. In this case, in the first frame 51, the first supported portion 511 is supported by the first side pillar lower portion 4112 in the first side pillar 411 of the first frame body 41, and the second supported portion 512 is supported by the second frame body lower portion 422 in the second frame body 42. In the first side pillar lower portion 4112, a supporting pin 81 of the discharge adjustment mechanism 8 to be described later is provided to protrude (FIG. 5). A supporting protrusion is provided in a part of the second frame body lower portion 422 corresponding to the first side pillar lower portion 4112. The first frame 51 is supported by the second unit supporting portion 45 in a state where the supporting pin 81 of the discharge adjustment mechanism 8 is inserted in the first insertion hole 511H of the first supported portion 511 and the supporting protrusion of the second frame body lower portion 422 is inserted in the second insertion hole 512H of the second supported portion 512.

The second frame 52 has a third supported portion 521 and a fourth supported portion 522 spaced apart from each other in the sheet conveying direction D1. In the present embodiment, in the second frame 52, the third supported portion 521 is arranged at a downstream end in the sheet conveying direction D1 and the fourth supported portion 522 is arranged closer to a downstream side, within a predetermined range, than to an upstream end in the sheet conveying direction D1. The second frame 52 is supported by either the first unit supporting portion 44 or the second unit supporting portion 45 in the third supported portion 521 and the fourth supported portion 522. In the second frame 52, the third supported portion 521 is provided with a third insertion hole 521H (FIG. 7) and the fourth supported portion 522 is provided with a fourth insertion hole 522H (FIG. 8).

It is assumed that the discharge unit 5 is supported in the first unit supporting portion 44. In this case, in the second frame 52, the third supported portion 521 is supported by the first supporting member 431 fixed to the side surface board 43 and the fourth supported portion 522 is supported by the second frame body upper portion 421 in the second frame body 42. The first supporting member 431 and a part of the second frame body upper portion 421 corresponding to the first supporting member 431 are provided with supporting protrusions, respectively. The second frame 52 is supported by the first unit supporting portion 44 in a state where the supporting protrusion of the first supporting member 431 is inserted in the third insertion hole 521H of the third supported portion 521 and the supporting protrusion of the second frame body upper portion 421 is inserted in the fourth insertion hole 522H of the fourth supported portion 522.

By contrast, it is assumed that the discharge unit 5 is supported by the second unit supporting portion 45. In this case, in the second frame 52, the third supported portion 521 is supported by the second supporting member 432 fixed to the side surface board 43, and the fourth supported portion 522 is supported by the second frame body lower portion 422 in the second frame body 42. The second supporting member 432 and a part of the second frame body lower portion 422 corresponding to the second supporting member 432 are provided with the supporting protrusions SP, respectively. The second frame 52 is supported by the second unit supporting portion 45 in a state where the supporting protrusion SP of the second supporting member 432 is inserted in the third insertion hole 521H of the third supported portion 521 and the supporting protrusion of the second frame body lower portion 422 is inserted in the fourth insertion hole 522H of the fourth supported portion 522.

As shown in FIG. 7, the attachment portion 54 is a part which is provided between the first frame 51 and the second frame 52 and to which the decurling unit 57 is attached in the discharge unit 5. In other words, the attachment portion 54 is defined by the first frame 51, the second frame 52, and the plurality of connecting members 53.

The receiving portion 55 is arranged, between the first frame 51 and the second frame 52, on an upstream side of the attachment portion 54 in the sheet conveying direction D1. The receiving portion 55, which is configured with, for example, a conveyance roller pair extending in the sheet width direction D2, rotates around a roller shaft to receive the sheet S having passed through the relay conveyance path 32. The sheet S received by the receiving portion 55 is introduced to the decurling unit 57 attached to the attachment portion 54. While subjecting the sheet S introduced by the receiving portion 55 to the decurling processing, the decurling unit 57 sends out the sheet S after the processing toward the downstream side.

The unit discharge portion 56 is arranged, between the first frame 51 and the second frame 52, on a downstream side of the attachment portion 54 in the sheet conveying direction D1. The unit discharge portion 56, which is configured with, for example, a conveyance roller pair extending in the sheet width direction D2, rotates around a roller shaft to conveyance the sheet S fed out from the decurling unit 57 further to the downstream side so as to be discharged. The sheet S discharged from the unit discharge portion 56 is carried, through the carry-in port CIP of the post-processing device 9 coupled to the relay conveyance device 3, into the post-processing device 9.

In the present embodiment, the receiving portion 55 and the unit discharge portion 56 are at the same position in the height direction D3 (height position) as the carry-in port CIP of the post-processing device 9 in a state where the discharge unit 5 is supported by either the first unit supporting portion 44 or the second unit supporting portion 45. "Having an same position" represents a state where a height position difference between each of the receiving portion 55 and the unit discharge portion 56 and the carry-in port CIP is within a predetermined allowable range. With a height position of the unit discharge portion 56 is same as that of the carry-in port CIP, discharging the sheet S horizontally from the unit discharge portion 56 enables the sheet to be introduced into the carry-in port CIP. This enables the discharge unit 5 to smoothly discharge the sheet S toward the carry-in port CIP of the post-processing device 9.

Figure 9:
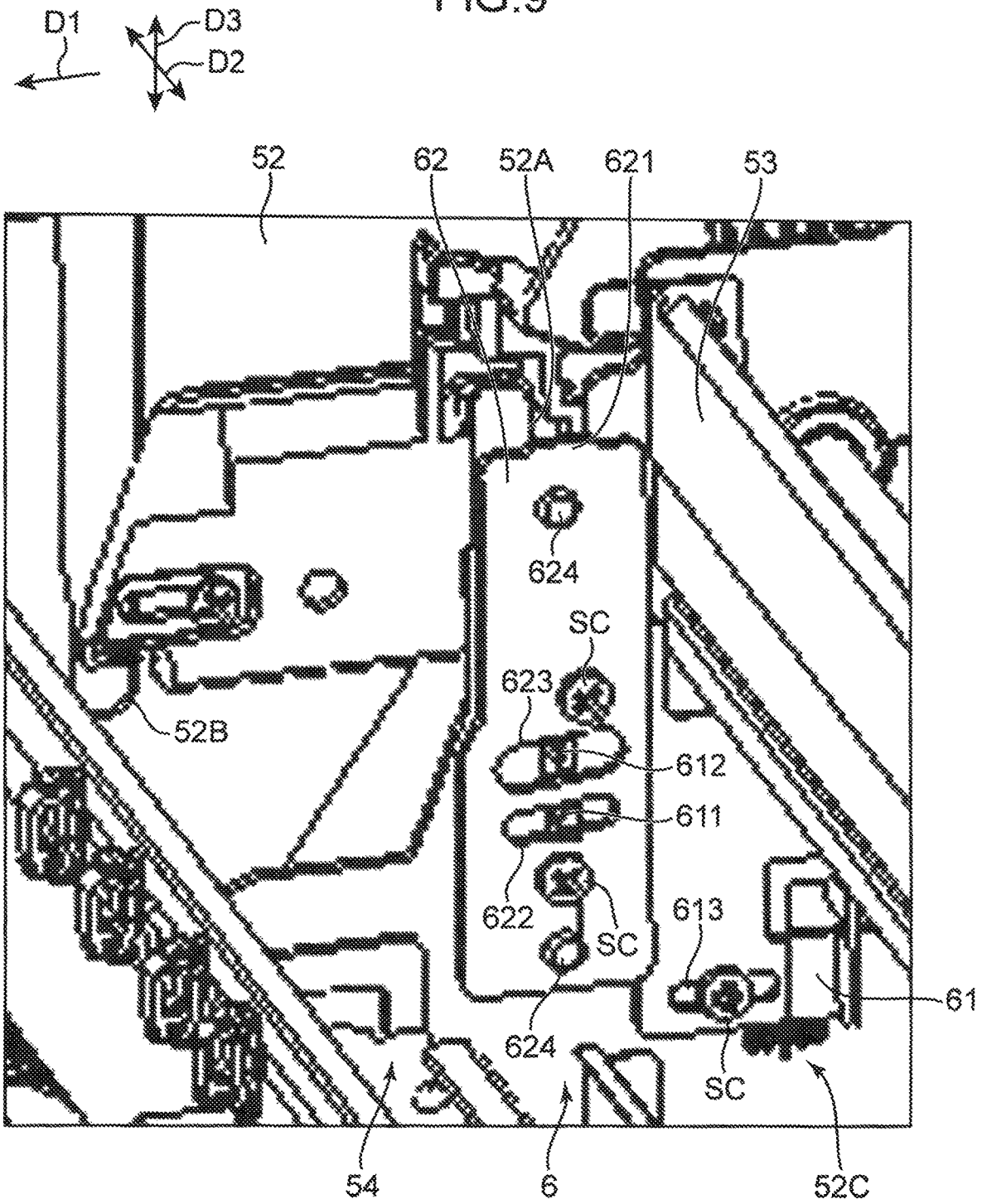
FIG. 9 is a perspective view showing, in an enlarged manner, a first processing position adjustment portion provided in an attachment portion of the discharge unit.
Figure 10A:
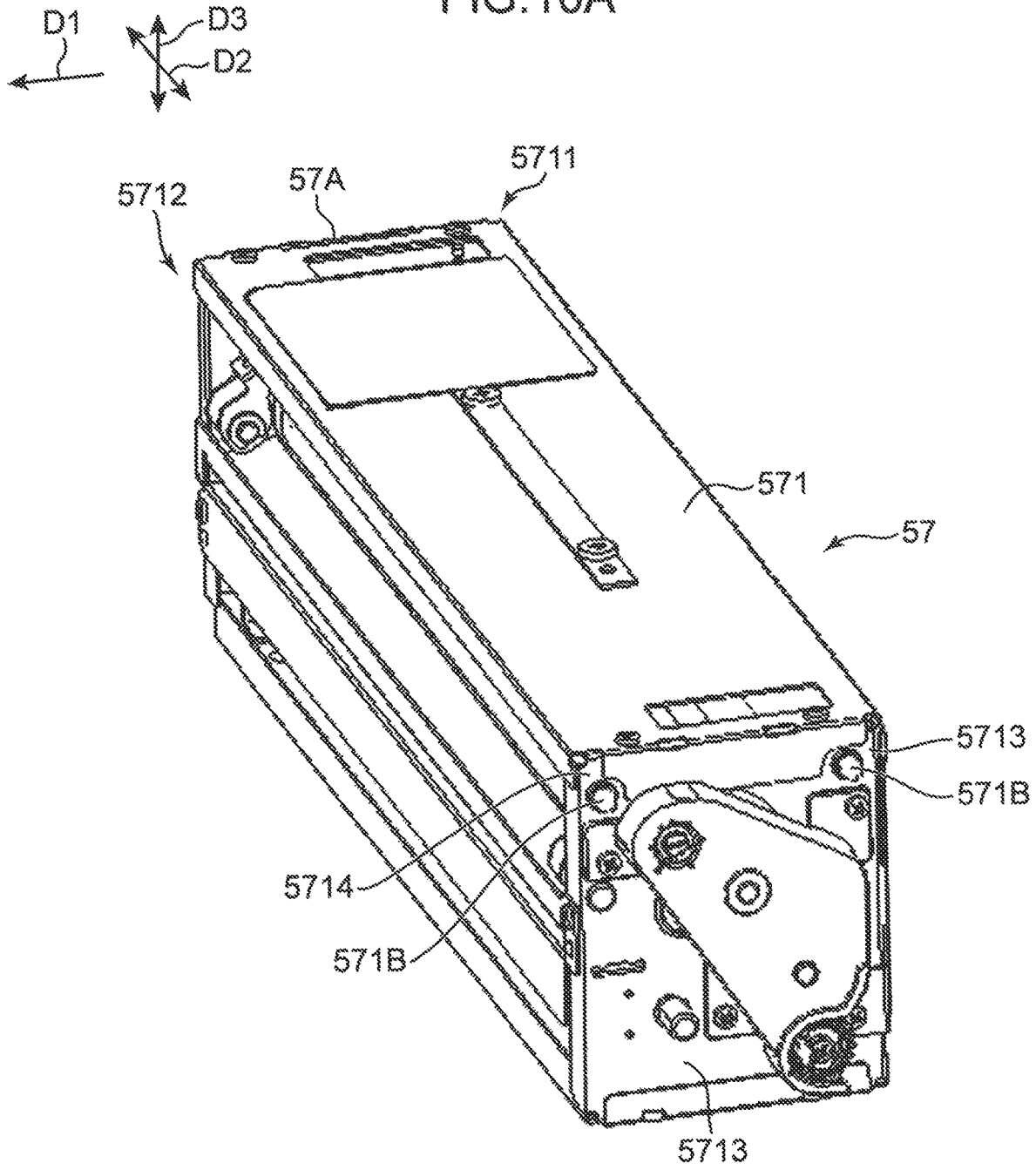
FIGS. 10A to 10C are perspective views of a decurling unit to be attached to the discharge unit.
Figure 10B:
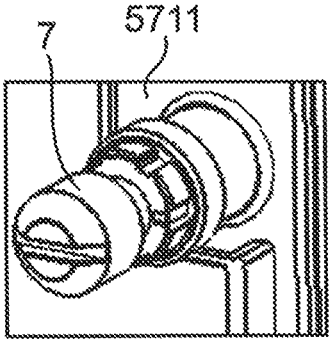
Figure 10C:
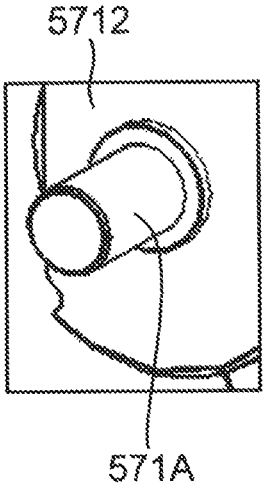
Figure 11:
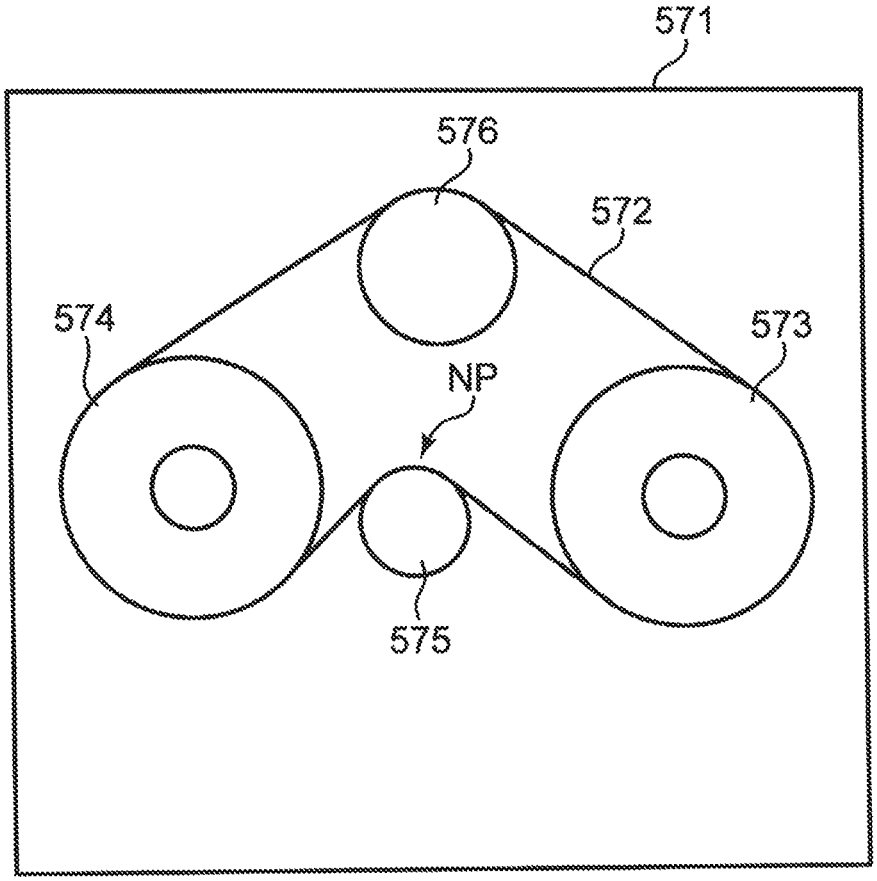
FIG. 11 is a view schematically showing an internal structure of the decurling unit.
Figure 12:
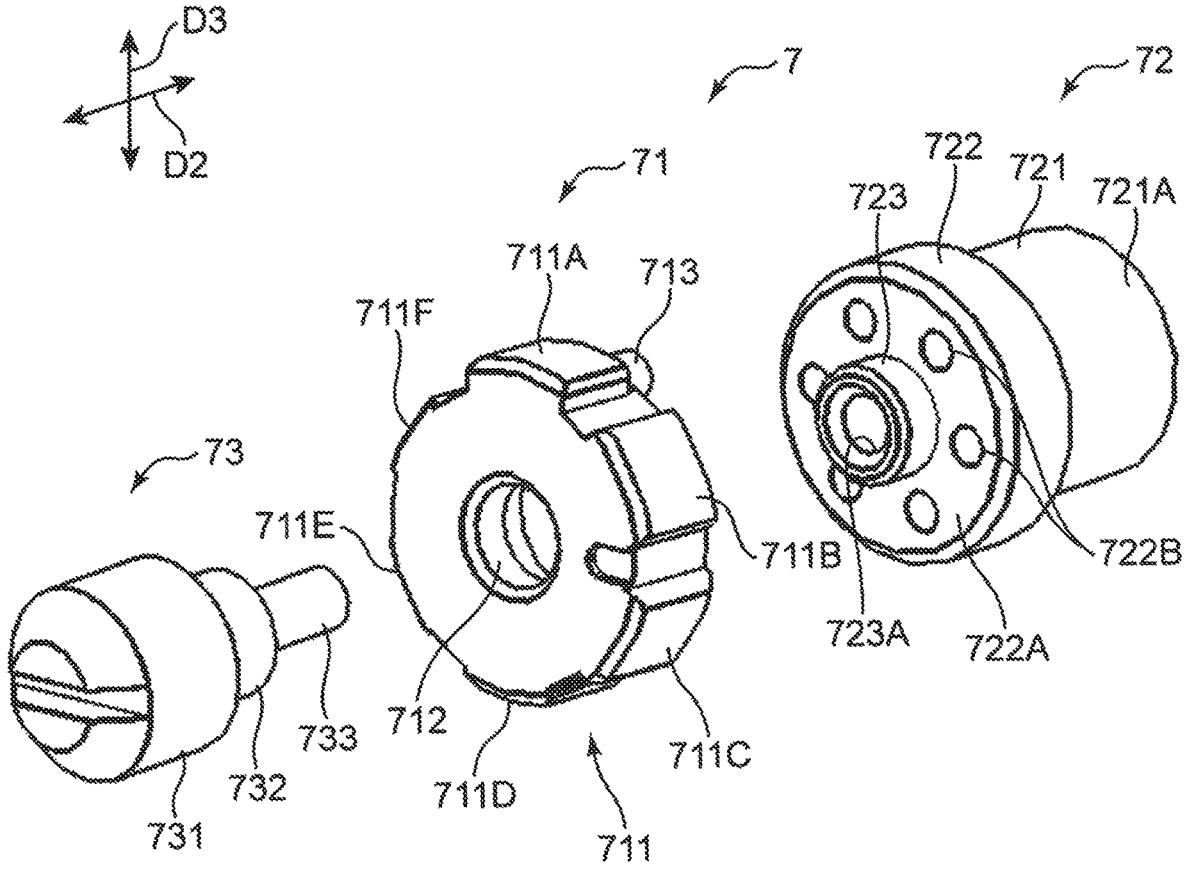
FIG. 12 is an exploded perspective view of a second processing position adjustment portion provided in the decurling unit.
Figure 13:
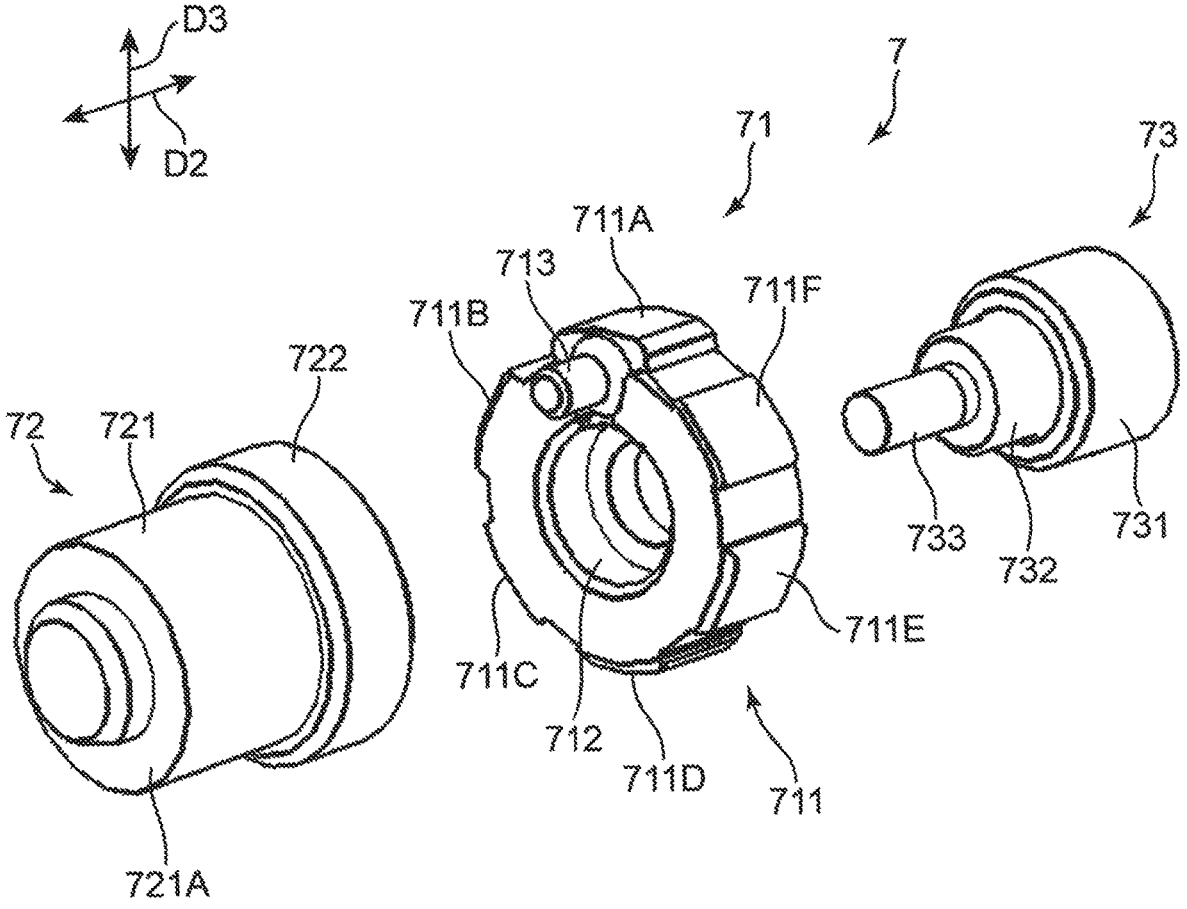
FIG. 13 is an exploded perspective view of the second processing position adjustment portion.

Next, description will be made of the decurling unit 57 to be attached to the attachment portion 54 of the discharge unit 5 with reference to FIG. 9 to FIG. 13. FIG. 9 is a perspective view showing, in an enlarged manner, a first processing position adjustment portion 6 provided in the attachment portion 54 of the discharge unit 5. FIGS. 10A to 10C are perspective views of the decurling unit 57, and FIG. 11 is a view schematically showing an internal structure of the decurling unit 57. FIG. 12 and FIG. 13 are exploded perspective views of a second processing position adjustment portion 7 provided in the decurling unit 57.

The decurling unit 57 is attached to the attachment portion 54 so as to be supported between the first frame 51 and the second frame 52 of the discharge unit 5. The decurling unit 57 is a unit which subjects the sheet S introduced by the receiving portion 55 to the decurling processing and sends out the sheet S after the processing to the unit discharge portion 56. The decurling unit 57 includes a housing 571, a decurling belt 572, a first supporting roller 573 and a second supporting roller 574 which form a pair of supporting rollers contained in the housing 571 and extending in the sheet width direction to rotate, a decurling roller 575, and a tension roller 576.

The housing 571 is a box-shaped (block-shaped) casing which houses each kind of structure configuring the decurling unit 57. The housing 571 has, on a first side wall 57A opposed to the second frame 52, a first supported region portion 5711 and a second supported region portion 5712 spaced apart from each other in the sheet conveying direction D1 set as shown in FIG. 10A. On the first side wall 57A of the housing 571, the first supported region portion 5711 is arranged on the upstream side in the sheet conveying direction D1 and the second supported region portion 5712 is arranged on the downstream side in the sheet conveying direction D1. On a second side wall 57B opposed to the first frame 51, the housing 571 has a third supported region portion 5713 and a fourth supported region portion 5714 set which are spaced apart from each other in the sheet conveying direction D1. On the second side wall 57B of the housing 571, the third supported region portion 5713 is arranged on the upstream side in the sheet conveying direction D1 and the fourth supported region portion 5714 is arranged on the downstream side in the sheet conveying direction D1.

The housing 571 is supported by the second frame 52 in the first supported region portion 5711 and the second supported region portion 5712 and is supported by the first frame 51 in the third supported region portion 5713 and the fourth supported region portion 5714. Specifically, the first supported region portion 5711 is provided with the second processing position adjustment portion 7 (FIG. 10B). The second supported region portion 5712 is provided with a supporting shaft 571A (FIG. 10C) having a transmission gear which transmits driving force for driving the first supporting roller 573 to rotate. Further, the third supported region portion 5713 and the fourth supported region portion 5714 are each provided with a supporting protrusion 571B. The housing 571 is supported by the second frame 52 at the second processing position adjustment portion 7 and the supporting shaft 571A in the first supported region portion 5711 and the second supported region portion 5712, and is as well supported by the first frame 51 at each supporting protrusion 571B of the third supported region portion 5713 and the fourth supported region portion 5714.

The decurling belt 572 is an endless belt having a width in the sheet width direction D2. The decurling belt 572 is extended over the first supporting roller 573 and the second supporting roller 574. The decurling belt 572 circulates as the first supporting roller 573 and the second supporting roller 574 rotate. The first supporting roller 573 and the second supporting roller 574 are arranged to be opposed to each other in the housing 571. The first supporting roller 573 is a driving roller extending along the sheet width direction D2. The first supporting roller 573 is rotatably supported by the first side wall 57A and the second side wall 57B which are both end portions of the housing 571 in a longitudinal direction. The first supporting roller 573 is driven to rotate by driving force of a driving motor input via the transmission gear of the supporting shaft 571A to cause the decurling belt 572 to circulate. The second supporting roller 574 is a driven roller extending along the sheet width direction D2. The second supporting roller 574 is rotatably supported by the first side wall 57A and the second side wall 57B which are both end portions of the housing 571 in the longitudinal direction. The second supporting roller 574 is driven to rotate in conjunction with circulation of the decurling belt 572.

A region, on an outer circumferential surface of the decurling belt 572, opposed to the decurling roller 575, the region being between the first supporting roller 573 and the second supporting roller 574, becomes a conveyance region for conveying the sheet S. In other words, the first supporting roller 573 defines a downstream end of the decurling unit 57 in the sheet conveying direction D1 and the second supporting roller 574 defines an upstream end of the decurling unit 57 in the sheet conveying direction D1.

The decurling roller 575 is a roller extending along the sheet width direction D2. The decurling roller 575 is rotatably supported by the first side wall 57A and the second side wall 57B which are both end portions of the housing 571 in the longitudinal direction. The decurling roller 575 is brought into contact, between the first supporting roller 573 and the second supporting roller 574, with the outer circumferential surface of the decurling belt 572 by pressing, and is driven to rotate in conjunction with circulation of the decurling belt 572. The decurling belt 572 forms, with the decurling roller 575, a nip portion NP through which the sheet S passes. The nip portion NP has a curved shape along an outer circumferential surface of the decurling roller 575. In other words, the curve-shaped nip portion NP has a radius of curvature equal to a radius of the decurling roller 575. The sheet S on which an image has been formed passes through the curve-shaped nip portion NP while being conveyed by the circulating decurling belt 572, resulting in being decurled.

The tension roller 576 is a roller which is provided on an inner circumferential surface side of the decurling belt 572 and applies tension to the decurling belt 572 while circulatably supporting the decurling belt 572. The tension roller 576 extends along the sheet width direction D2 and is driven to rotate in conjunction with circulation of the decurling belt 572.

As described above, in the decurling unit 57, the housing 571 has the first side wall 57A supported by the second frame 52 in the first supported region portion 5711 and the second supported region portion 5712, and has the second side wall 57B supported by the first frame 51 in the third supported region portion 5713 and the fourth supported region portion 5714. In the present embodiment, the first processing position adjustment portion 6 (FIG. 9) and the second processing position adjustment portion 7 (FIG. 10B) are provided for adjusting an inclination of the decurling unit 57 attached to the attachment portion 54 of the discharge unit 5.

The first processing position adjustment portion 6 and the second processing position adjustment portion 7 (both are processing unit adjustment portions) are set to be capable of adjusting an inclination in the height direction D3 of the decurling unit 57 relative to the sheet width direction D2 (a direction orthogonal to both directions of the height direction and the sheet conveying direction) such that the decurling unit 57 takes a predetermined horizontal reference position in a state where the decurling unit 57 is attached to the discharge unit 5, and the discharge unit 5 is supported by the first unit supporting portion 44. A position at which the first supporting roller 573 and the second supporting roller 574 are in line with the sheet width direction D2 in the decurling unit 57 is a reference position of the decurling unit 57. Adjusting the decurling unit 57 to take a reference position by the first processing position adjustment portion 6 and the second processing position adjustment portion 7 brings the first supporting roller 573 and the second supporting roller 574 to be parallel to each other. This enables meandering of the decurling belt 572 to be suppressed, the decurling belt being extended over the first supporting roller 573 and the second supporting roller 574. As a result, generation of belt damage and abnormal sound due to meandering of the decurling belt 572 can be suppressed as soon as possible, as well as appropriately decurling the sheet S having passed through the nip portion NP formed on the decurling belt 572. In the present embodiment, the first processing position adjustment portion 6 and the second processing position adjustment portion 7 are configured to be capable of adjusting a position of the first supported region portion 5711 in the housing 571 in the height direction D3 relative to the second supported region portion 5712, the third supported region portion 5713, and the fourth supported region portion 5714.

The first processing position adjustment portion 6 and the second processing position adjustment portion 7 are structures for adjusting a position in the height direction D3 of the first supported region portion 5711 in the housing 571, the first processing position adjustment portion 6 being provided in the second frame 52 and the second processing position adjustment portion 7 being provided in the first supported region portion 5711 of the housing 571.

As described above, with the second processing position adjustment portion 7 provided in the first supported region portion 5711 and the supporting shaft 571A provided in the second supported region portion 5712, the first side wall 57A of the housing 571 is supported by the second frame 52. With the supporting protrusion 571B provided in each of the third supported region portion 5713 and the fourth supported region portion 5714, the second side wall 57B of the housing 571 is supported by the first frame 51.

The first supported region portion 5711 of the housing 571, which will be described later, is supported by the second frame 52 as a result of contact of a cam member 71 in the second processing position adjustment portion 7 with a contact target portion 621 as shown in FIG. 9, FIG. 12, and FIG. 13. This case brings about a state where a barrel 732 of a fixing pin 73 in the second processing position adjustment portion 7 is inserted into a first notched portion 52A of the second frame 52. The first notched portion 52A has a tolerance with the barrel 732 in the sheet conveying direction D1 and the height direction D3. Specifically, the first supported region portion 5711 of the housing 571 is supported by the second frame 52 via the second processing position adjustment portion 7 in a state where displacement in the sheet conveying direction D1 and the height direction D3 is allowed at the time of position adjustment in the height direction D3 by the second processing position adjustment portion 7.

The second supported region portion 5712 of the housing 571 is supported by the second frame 52 by the insertion of the supporting shaft 571A into a positioning hole provided in the second frame 52. The positioning hole has a tolerance with the supporting shaft 571A neither in the sheet conveying direction D1 nor in the height direction D3. Specifically, the second supported region portion 5712 of the housing 571 is supported by the second frame 52 via the supporting shaft 571A in a state where displacement in the sheet conveying direction D1 and the height direction D3 is regulated.

The third supported region portion 5713 of the housing 571 is supported by the first frame 51 by the insertion of the supporting protrusion 571B into a supporting hole provided in the first frame 51. The supporting hole is a long hole extending in the sheet conveying direction D1 and has no tolerance with the supporting protrusion 571B in the height direction D3 but has a tolerance in the sheet conveying direction D1. Specifically, the third supported region portion 5713 of the housing 571 is supported by the first frame 51 via the supporting protrusion 571B in a state where displacement in the sheet conveying direction D1 is allowed and displacement in the height direction D3 is regulated.

The fourth supported region portion 5714 of the housing 571 is supported by the first frame 51 by the insertion of the supporting protrusion 571B into a positioning hole provided in the first frame 51. The positioning hole has a tolerance with the supporting protrusion 571B neither in the sheet conveying direction D1 nor in the height direction D3. Specifically, the fourth supported region portion 5714 of the housing 571 is supported by the first frame 51 via the supporting protrusion 571B in a state where displacement in the sheet conveying direction D1 and the height direction D3 is regulated.

Since supporting of the first to fourth supported region portions 5711, 5712, 5713, and 5714 in the housing 571 by each of the frames 51 and 52 is conducted in the above manner, the housing 571 will have no torsion caused by positional deviation in the sheet conveying direction D1 and will have torsion caused by positional deviation in the height direction D3. When torsion is generated in the housing 571, the first supporting roller 573 and the second supporting roller 574 will be arranged in a relation of torsional position, so that the decurling belt 572 will meander. For preventing torsion of the housing 571 as a cause of meandering of the decurling belt 572, it is necessary to adjust a position of the first supported region portion 5711 in the height direction D3 by a position adjustment portion of at least either the first processing position adjustment portion 6 or the second processing position adjustment portion 7.

The first processing position adjustment portion 6 includes a first board body 61 and a second board body 62 as shown in FIG. 9. The first processing position adjustment portion 6 is provided in a region part of the attachment portion 54 in the second frame 52 of the discharge unit 5.

The region part of the attachment portion 54 in the second frame 52, the region part being a part where the first processing position adjustment portion 6 is provided, has the first notched portion 52A and a second notched portion 52B which are notched downward from an upper side edge in the height direction D3, and a scale portion 52C formed near the first notched portion 52A. Into the first notched portion 52A, the barrel 732 of the fixing pin 73 is inserted, the fixing pin being in the second processing position adjustment portion 7 provided in the first supported region portion 5711 of the housing 571. In this state, the first supported region portion 5711 of the housing 571 is supported by the second frame 52 via the second processing position adjustment portion 7. Additionally, the supporting shaft 571A provided in the second supported region portion 5712 of the housing 571 is inserted into the second notched portion 52B. In this state, the second supported region portion 5712 of the housing 571 is supported by the second frame 52 via the supporting shaft 571A. The scale portion 52C, which will be detailed later, serves as a criterion for an amount of movement when the first board body 61 of the first processing position adjustment portion 6 is moved along the sheet conveying direction D1.

The first board body 61 is a substantially rectangular board body attached to the second frame 52 so as to be movable along the sheet conveying direction D1. The first board body 61 is attached on an upper side of the scale portion 52C in the second frame 52. The first board body 61 has a first protrusion pin 611, a second protrusion pin 612, and a positioning hole 613.

The first protrusion pin 611 is a pin protruding from the first board body 61 toward the first frame 51 and is inserted into an insertion hole 622 of the second board body 62 to be described later. The second protrusion pin 612 is a pin protruding from the first board body 61 toward the second frame 52. The second protrusion pin 612 is inserted into a pin guide hole formed in the second frame 52. The positioning hole 613 is a long hole extending along the sheet conveying direction D1. After position adjustment in the height direction D3 of the first supported region portion 5711 in the housing 571 by the first processing position adjustment portion 6, when positioning the first board body 61 with respect to the second frame 52 and fixing the same, a screw member SC is inserted into the positioning hole 613.

In the first board body 61 having the above configuration, the second protrusion pin 612 is inserted in the pin guide hole of the second frame 52 in a state where the first protrusion pin 611 is inserted in the insertion hole 622 of the second board body 62. In this manner, the first board body 61 is attached to the second frame 52 so as to be movable along the sheet conveying direction D1. When the first board body 61 is moved along the sheet conveying direction D1 with the scale portion 52C as a criterion for an amount of movement, the second protrusion pin 612 moves along the pin guide hole of the second frame 52.

The second board body 62 is a substantially rectangular board body supported by the first board body 61 through the first protrusion pin 611 so as to be movable in the height direction D3. The second board body 62 is arranged so as to be opposed to the first notched portion 52A in the second frame 52. The second board body 62 has the contact target portion 621, the insertion hole 622, a pin interference avoiding hole 623, and a third protrusion pin 624.

The contact target portion 621 is a part set at an upper side edge in the height direction D3 of the second board body 62. With the contact target portion 621, a cam surface 711 of the cam member 71 in the second processing position adjustment portion 7 contacts, the second processing position adjustment portion being in a state where the barrel 732 of the fixing pin 73 is inserted in the first notched portion 52A. The third protrusion pin 624 is a pin protruding, toward the second frame 52, in a region where the third protrusion pin 624 does not overlap the first board body 61 in the sheet width direction D2 in the second board body 62. The third protrusion pin 624 is inserted in the pin guide hole formed in the second frame 52.

The insertion hole 622 extends along the sheet conveying direction D1 so as to incline in the height direction D3 relative to the sheet conveying direction D1. Specifically, the insertion hole 622 in the second board body 62 is a long hole extending while inclining in the height direction D3 relative to the sheet conveying direction D1. In the present embodiment, the insertion hole 622 inclines to go upward from the downstream side toward the upstream side in the sheet conveying direction D1 so as to have an upstream side edge positioned above a downstream side edge as shown in FIG. 9. In the second board body 62, the first protrusion pin 611 of the first board body 61 is inserted in the insertion hole 622.

Similarly to the insertion hole 622, the pin interference avoiding hole 623 extends along the sheet conveying direction D1 so as to incline in the height direction D3 relative to the sheet conveying direction D1. The pin interference avoiding hole 623 is a hole portion which is positioned on an upper side of the insertion hole 622 for preventing the second board body 62 from interfering with the second protrusion pin 612 of the first board body 61.

Although illustration is omitted in FIG. 9, the second board body 62 has positioning holes as long holes which are formed at a predetermined position on a lower side of the insertion hole 622 and at a predetermined position on an upper side of the pin interference avoiding hole 623 and extend in the height direction D3. After position adjustment in the height direction D3 of the first supported region portion 5711 in the housing 571 by the first processing position adjustment portion 6, when positioning the second board body 62 with respect to the second frame 52 and fixing the same, the screw member SC is inserted into the positioning hole.

In the second board body 62 having the above configuration, the first board body 61 is moved along the sheet conveying direction D1 in a state where the first protrusion pin 611 of the first board body 61 is inserted in the insertion hole 622. When the first board body 61 moves along the sheet conveying direction D1, movement force of the first protrusion pin 611 caused by the movement acts on the insertion hole 622 in the second board body 62. Since the insertion hole 622 inclines in the sheet conveying direction D1 relative to the height direction D3, the force acting on the insertion hole 622 by the first protrusion pin 611 causes the second board body 62 to move in the height direction D3. When the second board body 62 moves in the height direction D3, the third protrusion pin 624 moves along the pin guide hole of the second frame 52. In the second board body 62, an angle of inclination of the insertion hole 622 relative to the sheet conveying direction D1 is set such that the second board body 62 has the same amount of movement in the height direction D3 as an amount of movement of the first board body 61 along the sheet conveying direction D1.

Moving the first board body 61 along the sheet conveying direction D1 to move the second board body 62 in the height direction D3 is conducted by a worker. Using a predetermined jig, the worker checks the inclination of the second frame 52, moves the first board body 61 according to the inclination while watching the scale portion 52C, and adjusts a position, in the height direction D3, of the contact target portion 621 set in the second board body 62.

As described above, in the first processing position adjustment portion 6, by the movement in the height direction D3 according to the movement of the first board body 61 along the sheet conveying direction D1, the second board body 62 is allowed to move the cam member 71 of the second processing position adjustment portion 7 in the height direction D3, the cam member having the cam surface 711 which contacts the contact target portion 621. This enables the second board body 62 to adjust a position of the first supported region portion 5711 in the housing 571 in the height direction D3, the first supported region portion 5711 being a portion in which the second processing position adjustment portion 7 having the cam member 71 as a part of the configuration is provided. At the time of moving the second board body 62 in the height direction D3 according to movement of the first board body 61 along the sheet conveying direction D1, a position in the height direction D3 of the first supported region portion 5711 in the housing 571 is adjusted such that the decurling unit 57 maintains the reference position. This brings the first supporting roller 573 and the second supporting roller 574 to be parallel to each other, thereby enabling meandering of the decurling belt 572 extended over the first supporting roller 573 and the second supporting roller 574 to be suppressed.

The second processing position adjustment portion 7 is provided in the first supported region portion 5711 in the housing 571 (FIG. 10B). The second processing position adjustment portion 7 includes the cam member 71, a holding member 72, and the fixing pin 73 as shown in FIG. 12 and FIG. 13. In the second processing position adjustment portion 7, the fixing pin 73, the cam member 71, and the holding member 72 are aligned in order from the outer side toward the inner side in the sheet width direction D2. In other words, in the second processing position adjustment portion 7, the cam member 71 is sandwiched between the holding member 72 and the fixing pin 73.

The cam member 71 is a cam having the cam surface 711 with which the predetermined contact target portion 621 set in the second frame 52 contacts. In the cam member 71, the cam surface 711 is zoned into a plurality of cam regions 711A, 711B, 711C, 711D, 711E, and 711F having different radii and arranged at an equal interval with a predetermined interval in a circumferential direction. In the example shown in FIG. 12 and FIG. 13, the cam surface 711 is zoned into the six cam regions of 711A, 711B, 711C, 711D, 711E, and 711F and is configured such that each cam region has a radius gradually changing toward one direction as a circumferential direction. The cam member 71 has a round-shaped through hole 712 formed at a central portion, as the center of a radius, of the cam surface 711 and a columnar protrusion portion 713 formed in a side surface portion to protrude to a side where the holding member 72 is arranged.

The holding member 72 is provided to protrude from the first supported region portion 5711 of the housing 571 toward the second frame 52 and holds the cam member 71. The holding member 72 has a columnar base portion 721, a flange portion 722, and a boss portion 723.

In the holding member 72, the base portion 721 is a part having one end portion 721A fixedly provided in the first supported region portion 5711 of the housing 571. The flange portion 722 is a part provided in the other end portion of the base portion 721 so as to outwardly protrude from an outer circumferential surface of the base portion 721. The flange portion 722 has, on an opposed surface 722A which is opposed to the cam member 71, a plurality of fit-in recessed portions 722B in which the protrusion portions 713 of the cam member 71 can engage. The number of the fit-in recessed portions 722B is the same as the number of cam regions on the cam surface 711 of the cam member 71. Specifically, six fit-in recessed portions 722B are formed at an equal interval in a circumferential direction of the opposed surface 722A of the flange portion 722 so as to correspond to the cam surface 711 zoned into the six cam regions 711A, 711B, 711C, 711D, 711E, and 711F. The boss portion 723 is a cylindrical part provided on the opposed surface 722A of the flange portion 722. A female screw portion is formed in an inner circumferential surface 723A of the boss portion 723. The holding member 72 configured with the base portion 721, the flange portion 722, and the boss portion 723 has the one end portion 721A of the base portion 721 fixedly provided to the first supported region portion 5711 of the housing 571, has any one of the fit-in recessed portions 722B of the flange portion 722 be fitted in by the protrusion portion 713 of the cam member 71, and holds the cam member 71 in a state where the boss portion 723 is inserted in the through hole 712 of the cam member 71.

The fixing pin 73 is attached to the holding member 72 with the cam member 71 sandwiched with the holding member 72, thereby fixing the cam member 71 to the holding member 72. The fixing pin 73 has a head portion 731, a screw portion 733 in which a male screw portion is formed, and the barrel 732 provided between the head portion 731 and the screw portion 733 and coupling the both portions. The fixing pin 73 is attached to the holding member 72 as a result of screwing of the male screw portion of the screw portion 733 with the female screw portion formed in the inner circumferential surface 723A of the boss portion 723 in a state where the boss portion 723 is inserted in the through hole 712 to hold the cam member 71 by the holding member 72. In a state where the fixing pin 73 is attached to the holding member 72 as a result of screwing of the screw portion 733 with the boss portion 723, the barrel 732 of the fixing pin 73 presses the cam member 71 to the holding member 72. In this manner, the fixing pin 73 fixes the cam member 71 to the holding member 72.

As described above, the second processing position adjustment portion 7 is provided in the first supported region portion 5711 of the housing 571. In the second processing position adjustment portion 7, a position of the fit-in recessed portion 722B in which the protrusion portion 713 of the cam member 71 fits determines a cam region of the cam surface 711, the cam region coming into contact with the contact target portion 621 set in the second board body 62 of the first processing position adjustment portion 6. The cam member 71 enables adjustment of a position, in the height direction D3, of the first supported region portion 5711 in the housing 571 by a change of a cam region contacting the contact target portion 621 in the plurality of cam regions 711A, 711B, 711C, 711D, 711E, and 711F of the cam surface 711. At the time of changing, on the cam surface 711 of the cam member 71, a cam region contacting the contact target portion 621, a position in the height direction D3 of the first supported region portion 5711 in the housing 571 is adjusted such that the decurling unit 57 maintains the reference position. Since this brings the first supporting roller 573 and the second supporting roller 574 to be parallel to each other, meandering of the decurling belt 572 extending over the first supporting roller 573 and the second supporting roller 574 can be suppressed.

The work of adjusting a position in the height direction D3 of the first supported region portion 5711 in the housing 571 by the second processing position adjustment portion 7 is conducted by a worker. Using a predetermined jig, the worker checks whether meandering of the decurling belt 572 has occurred or not, and when meandering has occurred, switches the fit-in recessed portion 722B in which the protrusion portion 713 of the cam member 71 fits. This switching work enables change of a cam region of the cam surface 711, the cam region contacting the contact target portion 621 in the cam member 71. In this manner, a position in the height direction D3 of the first supported region portion 5711 in the housing 571 can be adjusted.

In the discharge unit 5 configured to have the decurling unit 57 attached to the attachment portion 54, simply changing the unit supporting portion which supports the discharge unit 5 between the first unit supporting portion 44 and the second unit supporting portion 45 according to a height position of the carry-in port CIP of the post-processing device 9 might cause the decurling unit 57 to take a position different from a predetermined reference position. In a case where the decurling unit 57 takes a position different from the reference position, appropriate decurling processing for the sheet S cannot be conducted. Therefore, the relay conveyance device 3 according to the present embodiment includes the discharge adjustment mechanism 8 (FIG. 5).

The discharge adjustment mechanism 8 (a discharge unit adjustment mechanism) is a mechanism set to be capable of adjusting an inclination of the discharge unit 5 in the height direction D3 relative to the sheet width direction D2. The discharge adjustment mechanism 8 is set to be capable of adjusting an inclination of the discharge unit 5, in more detail, a height direction inclination of the discharge unit 5 in the sheet width direction such that the decurling unit 57 maintains the predetermined reference position in a state where the decurling unit 57 is adjusted to the reference position by the first processing position adjustment portion 6 or the second processing position adjustment portion 7 and is supported by the discharge unit 5 in either case where the discharge unit 5 is supported by the first unit supporting portion 44 or by the second unit supporting portion 45. The discharge adjustment mechanism 8 is set to be capable of adjusting an inclination of the discharge unit 5 by adjusting a position in the height direction D3 of any one supported portion among the first supported portion 511 and the second supported portion 512 of the first frame 51 and the third supported portion 521 and the fourth supported portion 522 of the second frame 52. In the present embodiment, the discharge adjustment mechanism 8 is set to be capable of adjusting an inclination of the discharge unit 5 by adjusting a position in the height direction D3 of the first supported portion 511 of the first frame 51. This enables change of the unit supporting portion which supports the discharge unit 5 between the first unit supporting portion 44 and the second unit supporting portion 45 according to a height position of the carry-in port CIP of the post-processing device 9, as well as enabling a reference position of the decurling unit 57 attached to the discharge unit 5 to be maintained. As a result, the discharge unit 5 is allowed to discharge the sheet S subjected to appropriate decurling processing in the decurling unit 57 toward the carry-in port CIP of the post-processing device 9.

The discharge adjustment mechanism 8 will be described in more detail with reference to FIG. 14 and FIG. 15 in addition to FIG. 5. FIGS. 14A to 14C are views showing the discharge adjustment mechanism 8. FIGS. 15A to 15C are views showing how an inclination of the discharge unit 5 is adjusted using the discharge adjustment mechanism 8.

The discharge adjustment mechanism 8 is provided in the second unit supporting portion 45. Specifically, the discharge adjustment mechanism 8 is provided in the first side pillar lower portion 4112 configuring the second unit supporting portion 45 in the first frame body 41 of the discharge portion main body 4 (see FIG. 5). The discharge adjustment mechanism 8 includes the supporting pin 81 which supports the first supported portion 511 of the first frame 51 in the discharge unit 5, a rotation shaft 82 provided in the first side pillar lower portion 4112, and an adjustment board 83 attached to the first side pillar lower portion 4112.

It is assumed that the discharge unit 5 is supported by the second unit supporting portion 45. In this case, as is already described, the first frame 51 of the discharge unit 5 is supported by the second unit supporting portion 45 in a state where the supporting pin 81 of the discharge adjustment mechanism 8 is inserted in the first insertion hole 511H of the first supported portion 511 and the supporting protrusion of the second frame body lower portion 422 is inserted in the second insertion hole 512H of the second supported portion 512. By contrast, the second frame 52 of the discharge unit 5 is supported by the second unit supporting portion 45 in a state where the supporting protrusion of the second supporting member 432 is inserted in the third insertion hole 521H of the third supported portion 521 and the supporting protrusion of the second frame body lower portion 422 is inserted in the fourth insertion hole 522H of the fourth supported portion 522. The discharge adjustment mechanism 8 is set to be capable of adjusting a position in the height direction D3 of the first supported portion 511 in the first frame 51 of the discharge unit 5 such that the decurling unit 57 is adjusted its position as the reference position after adjustment by the first processing position adjustment portion 6 and the second processing position adjustment portion 7 in a case where the discharge unit 5 is supported by the second unit supporting portion 45.

Figure 14A:
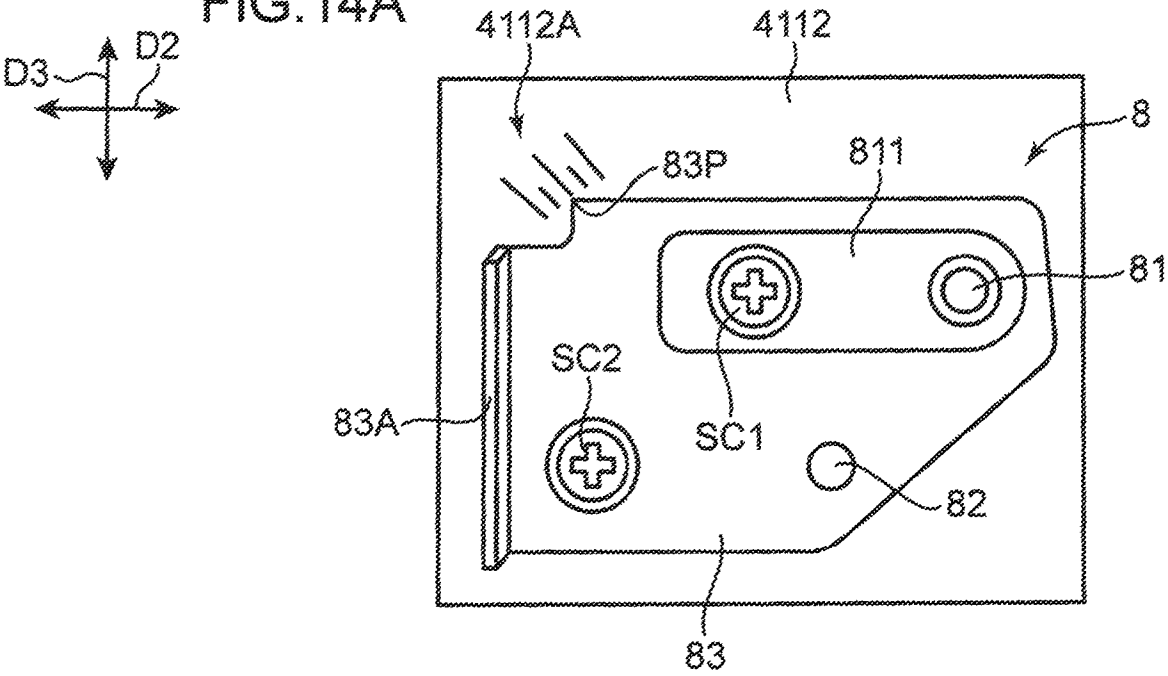
FIGS. 14A to 14C are views showing a discharge adjustment mechanism.

With reference to FIG. 14A, the supporting pin 81 is a pin member fixed to an attachment member 811. The supporting pin 81 is held at the adjustment board 83 by the attachment of the attachment member 811 to the adjustment board 83 by a first screw member SC1. The supporting pin 81 supports the first supported portion 511 while being inserted in the first insertion hole 511H of the first supported portion 511 in the first frame 51 of the discharge unit 5.

The adjustment board 83 is a board body which holds the supporting pin 81. The adjustment board 83 is attached to the first side pillar lower portion 4112 so as to be capable of rotating around the rotation shaft 82 provided in the first side pillar lower portion 4112 to protrude in the sheet conveying direction D1. The adjustment board 83 is set to be capable of adjusting a position in the height direction D3 of the first supported portion 511 in the first frame 51 of the discharge unit 5 by displacing the supporting pin 81 in the height direction D3 according to the rotation around the rotation shaft 82.

Figure 14C:
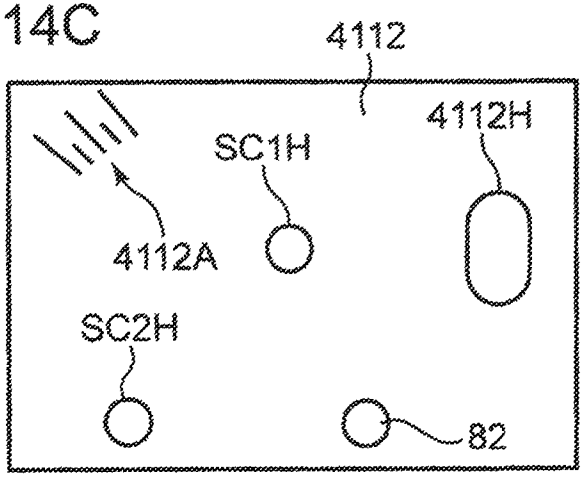
Figure 14B:
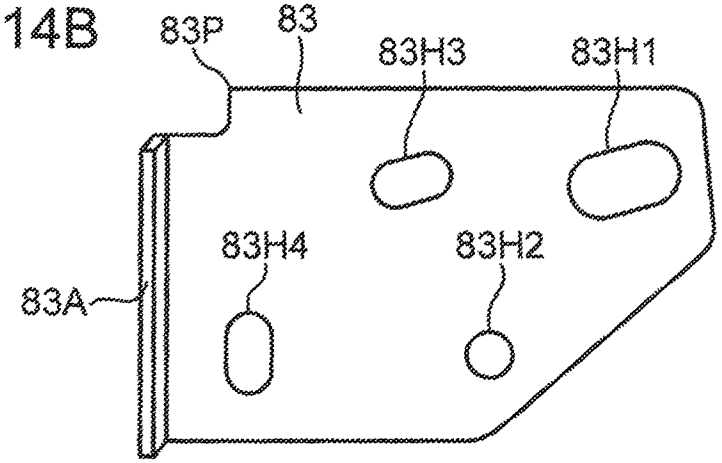

The adjustment board 83 has a first supporting pin insertion hole 83H1, a rotation shaft insertion hole 83H2, a first positioning hole 83H3, and a second positioning hole 83H4 as shown in FIG. 14B.

The first supporting pin insertion hole 83H1 is arranged at an end portion of the adjustment board 83, the end portion being on an upper side in the height direction D3 and being on an outer side in the sheet width direction D2. The first supporting pin insertion hole 83H1, which is a hole portion in which the supporting pin 81 is inserted, extends in the sheet width direction D2 to incline in the height direction D3 relative to the sheet width direction D2. Specifically, the first supporting pin insertion hole 83H1 is a long hole extending while inclining in the height direction D3 relative to the sheet width direction D2. In the present embodiment, as shown in FIG. 14, the first supporting pin insertion hole 83H1 inclines to go upward from an inner side toward an outer side so as to have an outer side edge positioned above an inner side edge in the sheet width direction D2.

The rotation shaft insertion hole 83H2 is arranged, in the adjustment board 83, on a lower side of the first supporting pin insertion hole 83H1 in the height direction D3 and on an inner side of the same in the sheet width direction D2. The rotation shaft insertion hole 83H2 is a hole portion in which the rotation shaft 82 is inserted. The adjustment board 83 is attached to the first side pillar lower portion 4112 by a second screw member SC2 in a state where the rotation shaft 82 is inserted in the rotation shaft insertion hole 83H2.

The first positioning hole 83H3 is arranged, in the adjustment board 83, at substantially the same position in the height direction D3 as the first supporting pin insertion hole 83H1 and on an inner side in the sheet width direction D2. The first positioning hole 83H3 extends in the sheet width direction D2 so as to incline in the height direction D3 relative to the sheet width direction D2 similarly to the first supporting pin insertion hole 83H1. In the first positioning hole 83H3, the first screw member SC1 is inserted for attaching, to the adjustment board 83, the attachment member 811 to which the supporting pin 81 is fixed.

The second positioning hole 83H4 is arranged, in the adjustment board 83, at an end portion on a lower side in the height direction D3, the end portion being on an inner side in the sheet width direction D2. The second positioning hole 83H4 is a long hole extending along the height direction D3. In the second positioning hole 83H4, the second screw member SC2 is inserted for attaching the adjustment board 83 to the first side pillar lower portion 4112.

As shown in FIG. 14C, in the first side pillar lower portion 4112 provided with the discharge adjustment mechanism 8, there are provided the rotation shaft 82 protruding in the sheet conveying direction D1, a scale portion 4112A and a second supporting pin insertion hole 4112H, and a first screw hole SC1H and a second screw hole SC2H. The scale portion 4112A, which will be detailed later, becomes a criterion for an amount of rotation of the adjustment board 83 around the rotation shaft 82. The second supporting pin insertion hole 4112H is a hole portion in which the supporting pin 81 is inserted and is a long hole extending along the height direction D3. The first screw hole SC1H is a screw hole with which the first screw member SC1 is screwed. The second screw hole SC2H is a screw hole with which the second screw member SC2 is screwed.

The adjustment board 83 is attached to the first side pillar lower portion 4112 by the screwing of the second screw member SC2 inserted in the second positioning hole 83H4 with the second screw hole SC2H. In the adjustment board 83 in this state, a rotation mark portion 83P is arranged near the scale portion 4112A to bring the rotation shaft 82 to be inserted in the rotation shaft insertion hole 83H2. The attachment member 811 to which the supporting pin 81 is fixed is attached to the first side pillar lower portion 4112 via the adjustment board 83 by the screwing of the first screw member SC1 inserted in the first positioning hole 83H3 with the first screw hole SC1H. In a state where the attachment member 811 is attached to the first side pillar lower portion 4112 via the adjustment board 83, the supporting pin 81 is brought to be inserted in the first supporting pin insertion hole 83H1 and the second supporting pin insertion hole 4112H.

The work of causing the adjustment board 83 to rotate around the rotation shaft 82 is conducted by a worker. In a state where the discharge unit 5 is supported by the second unit supporting portion 45, the worker checks whether meandering of the decurling belt 572 has occurred in the decurling unit 57 or not using a predetermined special purpose jig. When the decurling belt 572 meanders, the worker conducts work for rotating the adjustment board 83 around the rotation shaft 82. Before rotating the adjustment board 83, the worker brings screwing of the first screw member SC1 and the second screw member SC2 with the first screw hole SC1H and the second screw hole SC2H into a released state. Then, the worker grasps a rotation operation portion 83A provided on the adjustment board 83 while watching a position of the rotation mark portion 83P relative to the scale portion 4112A, thereby rotating the adjustment board 83. In this manner, the supporting pin 81 attached to the adjustment board 83 via the attachment member 811 is displaced in the height direction D3. As a result, it is possible to adjust a position in the height direction D3 of the first supported portion 511 in the first frame 51 of the discharge unit 5, the first supported portion 511 being supported by the supporting pin 81, such that the decurling unit 57 takes a predetermined reference position in the attachment portion 54 of the discharge unit 5 supported by the second unit supporting portion 45.

Figure 15A:
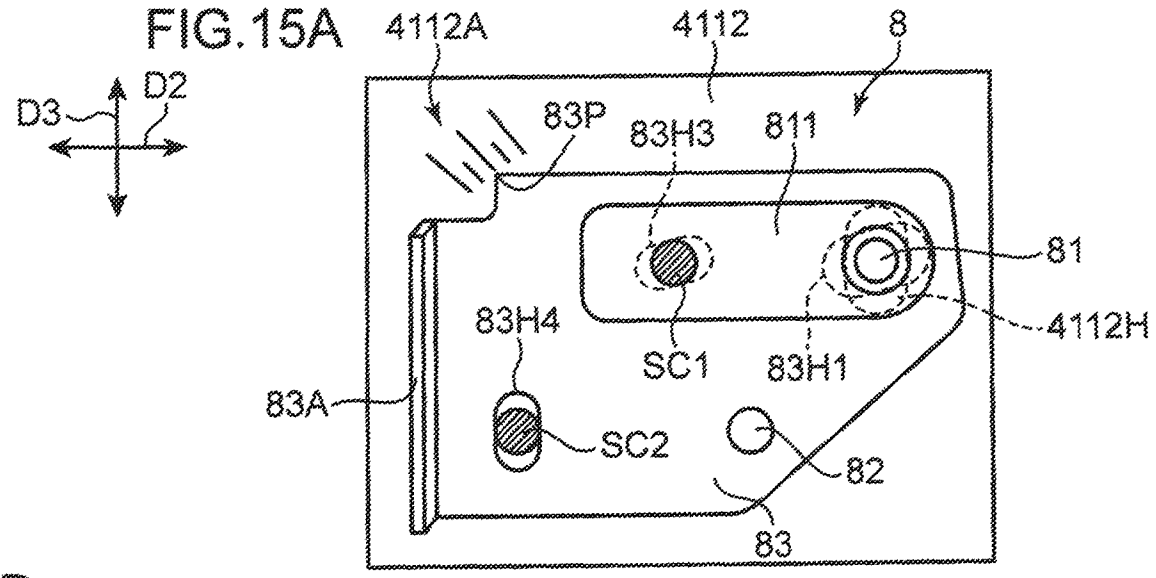
FIGS. 15A to 15C are views showing how an inclination of the discharge unit is adjusted using the discharge adjustment mechanism.
Figure 15C:
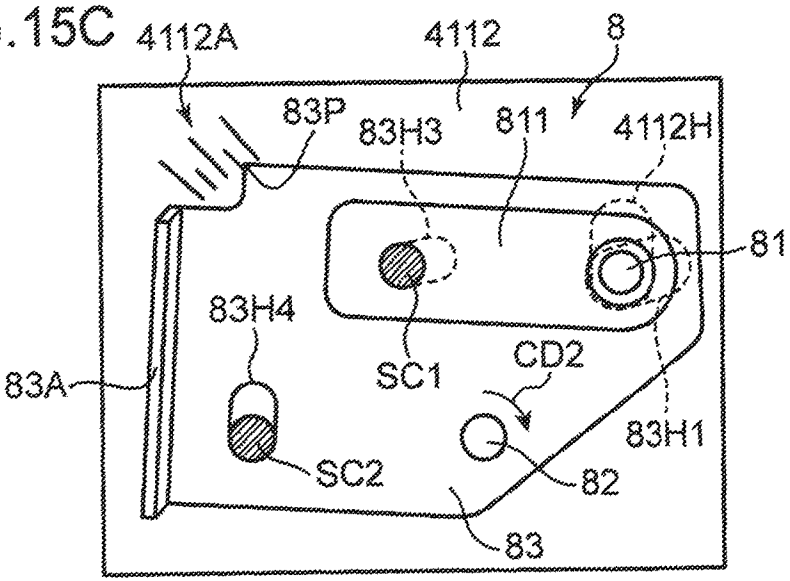
Figure 15B:
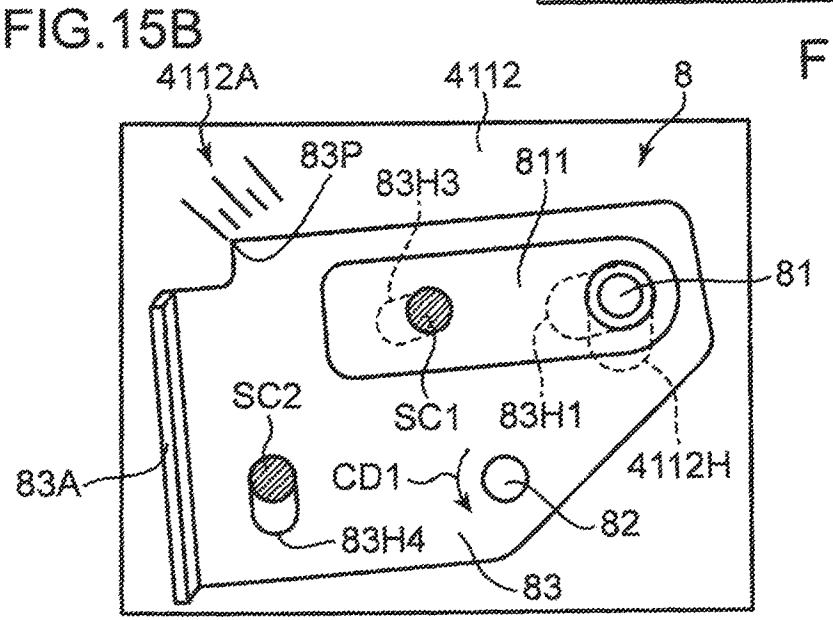

With reference to FIGS. 15A to 15C, description will be made of how the supporting pin 81 displaces in the height direction D3 according to the rotation of the adjustment board 83.

It is assumed that in a state where screwing of the first screw member SC1 and the second screw member SC2 with the first screw hole SC1H and the second screw hole SC2H is released, the adjustment board 83 is rotated around the rotation shaft 82 in a counterclockwise direction CD1 (FIG. 15B). In this case, the first screw member SC1 inserted in the first screw hole SC1H will near to an outer side edge in the sheet width direction D2 of the first positioning hole 83H3 in the adjustment board 83. Similarly, the second screw member SC2 inserted in the second screw hole SC2H will near to an upper side edge in the height direction D3 of the second positioning hole 83H4 in the adjustment board 83.

When the adjustment board 83 is rotated in the counterclockwise direction CD1, rotational force of the adjustment board 83 acts on the supporting pin 81 inserted in the first supporting pin insertion hole 83H1. Since the first supporting pin insertion hole 83H1 inclines to go upward from an inner side toward an outer side in the sheet width direction D2, the supporting pin 81 will be displaced upward in the height direction D3 along the first supporting pin insertion hole 83H1. The supporting pin 81 is inserted also in the second supporting pin insertion hole 4112H of the first side pillar lower portion 4112. Since the second supporting pin insertion hole 4112H is a long hole extending in the height direction D3, when displaced along the first supporting pin insertion hole 83H1, the supporting pin 81 is allowed to have displacement in the height direction D3 while having displacement in the sheet width direction D2 regulated. By the displacement of the supporting pin 81 in the height direction D3 according to the rotation of the adjustment board 83, a position of the first supported portion 511 in the height direction D3 in the first frame 51 of the discharge unit 5 can be adjusted.

Next, it is assumed that in a state where screwing of the first screw member SC1 and the second screw member SC2 with the first screw hole SC1H and the second screw hole SC2H is released, the adjustment board 83 is rotated around the rotation shaft 82 in a clockwise direction CD2 (FIG. 15C). In this case, the first screw member SC1 inserted in the first screw hole SC1H will near to an inner side edge in the sheet width direction D2 of the first positioning hole 83H3 in the adjustment board 83. Similarly, the second screw member SC2 inserted in the second screw hole SC2H will near to a lower side edge in the height direction D3 of the second positioning hole 83H4 in the adjustment board 83.

When the adjustment board 83 is rotated in the clockwise direction CD2, rotational force of the adjustment board 83 acts on the supporting pin 81 inserted in the first supporting pin insertion hole 83H1. Since the first supporting pin insertion hole 83H1 inclines to go upward from an inner side toward an outer side in the sheet width direction D2, the supporting pin 81 will be displaced downward in the height direction D3 along the first supporting pin insertion hole 83H1. At this time, the supporting pin 81 is allowed to have displacement in the height direction D3 by the second supporting pin insertion hole 4112H while having displacement in the sheet width direction D2 regulated. By the displacement of the supporting pin 81 in the height direction D3 according to the rotation of the adjustment board 83, a position of the first supported portion 511 in the height direction D3 in the first frame 51 of the discharge unit 5 can be adjusted.

When adjustment of the position of the first supported portion 511 in the height direction D3 in the first frame 51 of the discharge unit 5 is finished, screwing of the first screw member SC1 and the second screw member SC2 with the first screw hole SC1H and the second screw hole SC2H is fastened. This causes the adjustment board 83 to be fixed to the first side pillar lower portion 4112, as well as fixing the attachment member 811 to the first side pillar lower portion 4112 via the adjustment board 83. As a result, the supporting pin 81 fixed to the attachment member 811 is positioned with respect to the first side pillar lower portion 4112. The supporting pin 81 positioned with respect to the first side pillar lower portion 4112 has displacement in the height direction D3 regulated by the first supporting pin insertion hole 83H1 and has displacement in the sheet width direction D2 regulated by the second supporting pin insertion hole 4112H.

As described in the foregoing, in the relay conveyance device 3 according to the present embodiment, the discharge adjustment mechanism 8 is set to be capable of adjusting an inclination of the discharge unit 5 by adjusting a position in the height direction D3 of the first supported portion 511 of the first frame 51. This enables the unit supporting portion which supports the discharge unit 5 to be changed between the first unit supporting portion 44 and the second unit supporting portion 45 according to a height position of the carry-in port CIP of the post-processing device 9, as well as enabling a reference position of the decurling unit 57 attached to the discharge unit 5 to be maintained. As a result, the discharge unit 5 is allowed to discharge the sheet S subjected to appropriate decurling processing in the decurling unit 57 toward the carry-in port CIP of the post-processing device 9.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A relay conveyance device arranged between an image forming device which forms an image on a sheet and a post-processing device applying predetermined post-processing to a sheet to relay conveyance of a sheet from the image forming device to the post-processing device, the post-processing device having a carry-in port which allows carry-in of a sheet, the relay conveyance device comprising:

a device main body in which a relay conveyance path is provided as a conveyance path of a sheet fed out from the image forming device;

a plurality of unit supporting portions provided, at a downstream end of the device main body in a sheet conveying direction, at positions different from each other in the height direction;

a discharge unit supported by any one of the plurality of unit supporting portions to receive a sheet having passed through the relay conveyance path and discharge the sheet toward the carry-in port;

a processing unit attached to the discharge unit to apply predetermined processing to the sheet;

a processing unit adjustment portion capable of adjusting a height direction inclination of the processing unit relative to a sheet width direction orthogonal to both the height direction and the sheet conveying direction such that the processing unit takes a horizontal reference position in a state where the processing unit is attached to the discharge unit; and a discharge unit adjustment mechanism capable of adjusting an inclination in the height direction of the discharge unit relative to the sheet width direction such that the processing unit adjusts the reference position in a state where in each of the plurality of unit supporting portions, the processing unit is supported by the discharge unit.

2. The relay conveyance device according to claim 1, wherein the discharge unit includes:

a first frame having a first supported portion and a second supported portion spaced apart from each other in the sheet conveying direction and supported by the unit supporting portion in the first supported portion and the second supported portion;

a second frame arranged to be opposed to the first frame in the sheet width direction, having a third supported portion and a fourth supported portion spaced apart from each other in the sheet conveying direction, and supported by the unit supporting portions in the third supported portion and the fourth supported portion;

a plurality of connecting members which extend in the sheet width direction and connects the first frame and the second frame; and an attachment portion which is defined by the first frame, the second frame, and the plurality of connecting members and in which the processing unit is attached, and the discharge unit adjustment mechanism adjusts an inclination of the discharge unit by adjusting a position in the height direction of at least one of the first supported portion, the second supported portion, the third supported portion, and the fourth supported portion such that the processing unit maintains the reference position even in a case where in a state where the processing unit adjusted to the reference position is attached to the attachment portion, the discharge unit is supported by any of the plurality of unit supporting portions.

3. The relay conveyance device according to claim 2, wherein the discharge unit adjustment mechanism is provided in each of the plurality of unit supporting portions and is set to be capable of adjusting a position in the height direction of the first supported portion such that the processing unit maintains its position as the reference position after adjustment by the processing unit adjustment portion.

4. The relay conveyance device according to claim 3, wherein the discharge unit adjustment mechanism includes:

a supporting pin which supports the first supported portion;

a rotation shaft provided in each of the plurality of unit supporting portions; and an adjustment board that holds the supporting pin and is attached to each of the plurality of unit supporting portion so as to be capable of rotating around the rotation shaft, the adjustment board being capable of adjusting a position in the height direction of the first supported portion by displacing the supporting pin in the height direction according to the rotation around the rotation shaft portion.

5. The relay conveyance device according to claim 2, wherein the discharge unit further includes:

a receiving portion arranged, between the first frame and the second frame, on an upstream side of the attachment portion in the sheet conveying direction to receive a sheet having passed through the relay conveyance path; and a unit discharge portion arranged, between the first frame and the second frame, on a downstream side of the attachment portion in the sheet conveying direction to discharge a sheet having been subjected to processing by the processing unit toward the carry-in port, the receiving portion and the unit discharge portion are at the same position in the height direction as the carry-in port in a state where the discharge unit is supported by the unit supporting portion.

6. The relay conveyance device according to claim 1, wherein the processing unit is a decurling unit which applies decurling processing to an introduced sheet and sends out the sheet after the processing, the decurling unit including:

a housing;

a pair of supporting rollers contained in the housing and extending in the sheet width direction to rotate;

a decurling belt extended over the pair of supporting rollers to circulate; and a decurling roller which is brought into contact with an outer circumferential surface of the decurling belt by pressing and forms a curve-shaped nip portion with the outer circumferential surface, the sheet passing through the nip portion.

7. The relay conveyance device according to claim 1, wherein the relay conveyance path has an inversion path which reverses back and front of a sheet, and a correction path which corrects a position of the sheet in the sheet width direction.

8. An image forming system comprising:

an image forming device which forms an image on a sheet;

a post-processing device having a carry-in port which allows carry-in of a sheet and applying predetermined post-processing to a sheet; and the relay conveyance device according to claim 1 arranged between the image forming device and the post-processing device to relay conveyance of a sheet from the image forming device to the post-processing device.

9. A combination of an image forming system comprising:

an image forming device which forms an image on a sheet;

a plurality of kinds of post-processing devices each capable of applying predetermined post-processing to a sheet and each having a carry-in port which allows carry-in of a sheet and which has a position in a height direction different from each other; and the relay conveyance device according to claim 1 arranged between the image forming device and one post-processing device selected from the plurality of kinds of post-processing devices to relay conveyance of a sheet from the image forming device to the one post-processing device.

10. A sheet conveyance device arranged on an upstream side of a post-processing device which applies predetermined post-processing to the sheet, to convey the sheet to the post-processing device, the post-processing device having a carry-in port which allows carry-in of a sheet, the sheet conveyance device comprising:

a device main body in which a conveyance path is provided;

a plurality of unit supporting portions provided, at a downstream end of the device main body in a sheet conveying direction, at positions different from each other in the height direction;

a discharge unit supported by any one of the plurality of unit supporting portions to receive a sheet having passed through the conveyance path and discharge the sheet toward the carry-in port;

a processing unit attached to the discharge unit to apply predetermined processing to the sheet;

a processing unit adjustment portion capable of adjusting a height direction inclination of the processing unit relative to a sheet width direction orthogonal to both the height direction and the sheet conveying direction such that the processing unit takes a horizontal reference position in a state where the processing unit is attached to the discharge unit; and a discharge unit adjustment mechanism capable of adjusting an inclination in the height direction of the discharge unit relative to the sheet width direction such that the processing unit adjusts the reference position in a state where in each of the plurality of unit supporting portions, the processing unit is supported by the discharge unit.

* * * * *